US010150535B2

(12) United States Patent
Hellesmark et al.

(10) Patent No.: US 10,150,535 B2
(45) Date of Patent: Dec. 11, 2018

(54) SYSTEMS, METHODS AND UNITS FOR OFFLOADING OR LOADING CARGO AT SEA

(71) Applicant: 7 Seas Technology AS, Fevik (NO)

(72) Inventors: Svein Børge Hellesmark, Fevik (NO); Keith Gill, Salida, CO (US); Per Gunnar Andersen, Stavanger (NO)

(73) Assignee: 7 Seas Technology AS, Fevik (NO)

( * ) Notice: Subject to any disclaimer, the term of this patent is extended or adjusted under 35 U.S.C. 154(b) by 0 days.

(21) Appl. No.: 15/443,357

(22) Filed: Feb. 27, 2017

(65) Prior Publication Data

US 2017/0253302 A1 Sep. 7, 2017

Related U.S. Application Data

(60) Provisional application No. 62/302,242, filed on Mar. 2, 2016, provisional application No. 62/326,080, filed on Apr. 22, 2016.

(51) Int. Cl.
*F17C 9/02* (2006.01)
*B63B 35/44* (2006.01)
(Continued)

(52) U.S. Cl.
CPC ..... *B63B 22/021* (2013.01); *B63B 27/24* (2013.01); *B63B 27/34* (2013.01); *B67D 9/00* (2013.01);
(Continued)

(58) Field of Classification Search
CPC ..... B63B 27/24; B63B 27/34; B63B 22/023
See application file for complete search history.

(56) References Cited

U.S. PATENT DOCUMENTS 3,715,890 A * 2/1973 Langner ..... B63B 35/03 114/144 B
5,803,779 A * 9/1998 Horton, III ..... B63B 22/021 114/230.23

(Continued)

FOREIGN PATENT DOCUMENTS

WO 2015/107147 7/2015

*Primary Examiner* — Gregory W Adams
(74) *Attorney, Agent, or Firm* — Andrus Intellectual Property Law, LLP

(57) ABSTRACT

Offloading cargo from a cargo vessel and delivering the cargo to a cargo recipient, or loading cargo onto the cargo vessel from a cargo supplier, may be performed using a cargo vessel which is spread moored at sea to a plurality of mooring points for mooring the cargo vessel in a desired orientation. Alternatively, the cargo vessel may be rotatably moored. Tubing may be provided and configured to be connected to the vessel for fluid communication between the vessel and the cargo recipient or the cargo supplier, and may comprise a first portion configured to be connected to the cargo vessel and a second portion configured to be connected to the cargo recipient or the cargo supplier. A semi-submersible unit may be operable to travel across the sea and carry part of the tubing from a stand-by location to a position adjacent to the cargo vessel, so as to allow an end of the first portion of the tubing to be connected the cargo vessel for offloading or loading the cargo. The unit may have at least one lifting and handling device, which when the unit is positioned adjacent to the cargo vessel, may be operable for arranging the end of the first portion of the tubing at or near a manifold on the cargo vessel for connection thereto.

38 Claims, 18 Drawing Sheets

(51) Int. Cl.

| | |
|---|---|
| ***B63B 22/02*** | (2006.01) |
| ***B63B 27/24*** | (2006.01) |
| ***B63B 27/34*** | (2006.01) |
| ***B67D 9/00*** | (2010.01) |
| ***F17C 9/00*** | (2006.01) |

(52) U.S. Cl.
CPC ..... *F17C 9/00* (2013.01); *B63B 2035/448* (2013.01); *F17C 2270/0118* (2013.01); *F17C 2270/0126* (2013.01)

(56) References Cited

U.S. PATENT DOCUMENTS

| | | | | |
|---|---|---|---|---|
| 7,056,177 | B2 * | 6/2006 | Poldervaart | B63B 21/50 441/4 |
| 7,287,484 | B2 * | 10/2007 | Landry | B63B 22/02 114/219 |
| 7,624,582 | B2 * | 12/2009 | Hellesmark | B63B 27/24 114/264 |
| 8,104,416 | B1 * | 1/2012 | Shivers, III | B63B 27/24 114/230.14 |
| 8,286,678 | B2 * | 10/2012 | Adkins | B63B 22/026 114/230.15 |

* cited by examiner

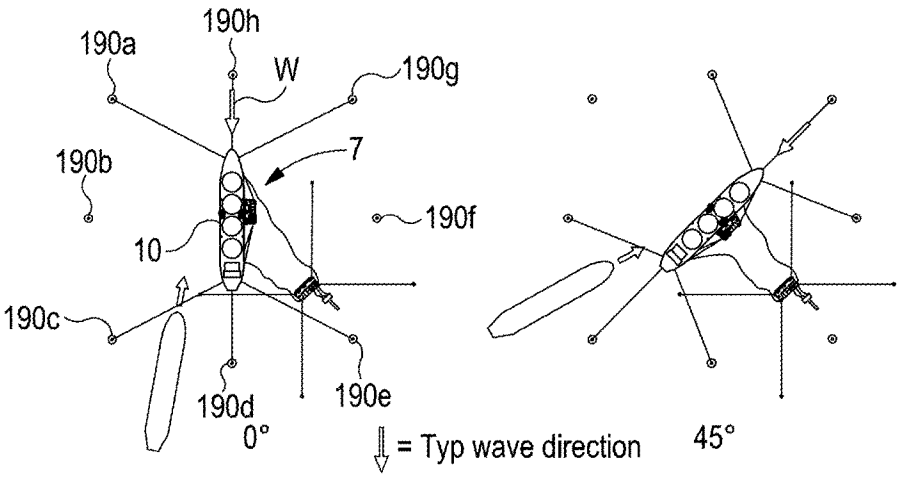
FIG. 26A
FIG. 26B
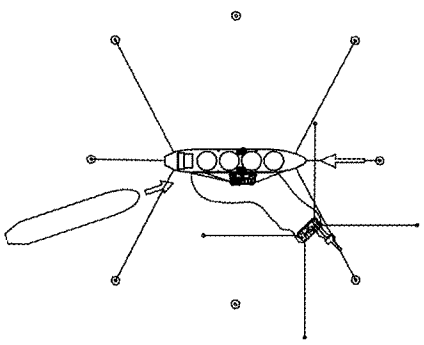
FIG. 26C
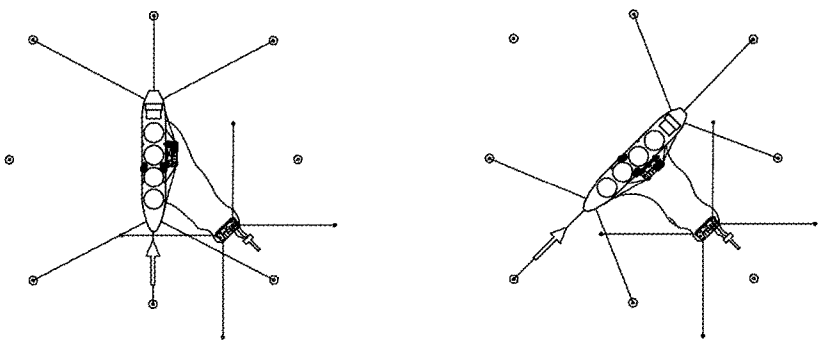
FIG. 26D
FIG. 26E
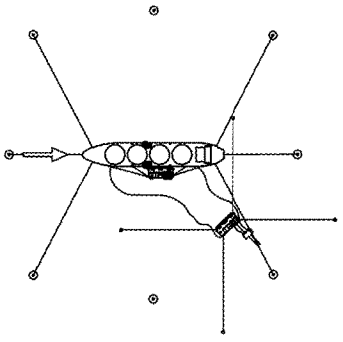
FIG. 26F

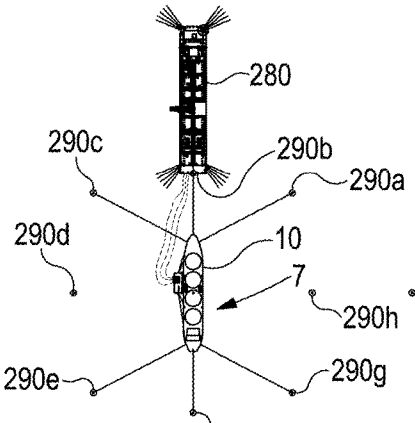
FIG. 28A
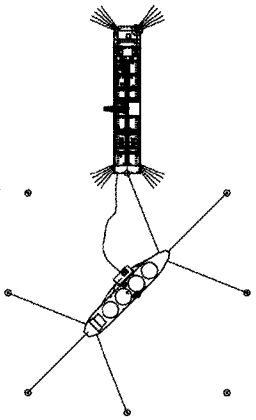
FIG. 28B
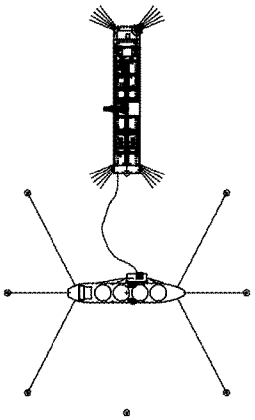
FIG. 28C
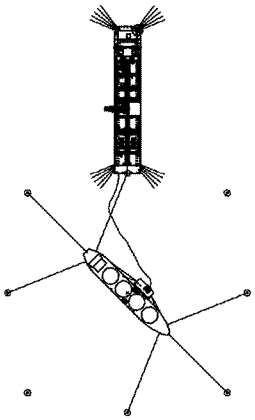
FIG. 28D
FIG. 28E
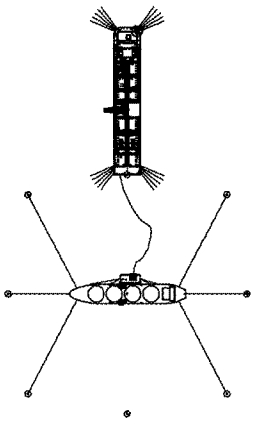
FIG. 28F
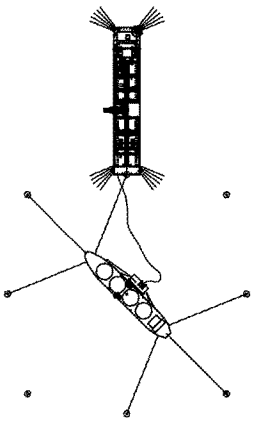
FIG. 28G

SYSTEMS, METHODS AND UNITS FOR OFFLOADING OR LOADING CARGO AT SEA

CROSS-REFERENCE TO RELATED APPLICATIONS

This application claims the benefit of and priority to U.S. Provisional Patent Application No. 62/302,242, filed Mar. 2, 2016 and U.S. Provisional Patent Application No. 62/326,080, filed Apr. 22, 2017, which both are hereby incorporated by reference in entirety.

TECHNICAL FIELD

The present invention relates to the offloading or loading of cargo vessels, and in particular, relates to a unit for allowing connection of tubing to a cargo vessel for offloading cargo from the cargo vessel to a cargo recipient or loading cargo onto the cargo vessel from a cargo supplier. The cargo supplier or recipient may include a transport pipeline for transporting the cargo onto or away from shore. The cargo may for instance be LNG, LPG, or similar. The invention further relates in particular to systems and methods of offloading or loading such cargo.

BACKGROUND

A variety of technical challenges can arise in the export and import of products, in particular with regard to importing or exporting fluid products to or from shore while providing solutions which are efficient and of reasonable cost. One particular market in strong growth is that of the import and export of liquefied natural gas (LNG). In this market, LNG is carried as cargo on large LNG ships (LNG carriers) and is offloaded from the LNG carrier into pipelines or storage facilities for further use or processing. Traditionally, the LNG is loaded onto or offloaded from the LNG carriers at marine LNG terminals at various shore-side locations.

A typical marine LNG terminal normally has a long jetty (often 1 to 5 km long) arranged a distance away from shore and a mooring arrangement for large LNG ships (e.g. 300 m long) together with associated loading equipment such as LNG loading arms. The jetty is typically provided in sheltered water for instance protected by a breakwater. A pipeline on the jetty may then typically be connected to the cargo manifold of the cargo vessel (e.g. an LNG carrier), using the equipment at the terminal. This arrangement provides calm conditions suitable for offloading or loading LNG. However, the breakwater is a large structure (typically 1 km long or more), and the total costs for a providing a marine LNG terminal of this type may be very significant.

Traditional import terminals for LNG also typically include a vapor return line between onshore or offshore storage tanks and the visiting LNG carrier. The reason for the vapor return line is that the LNG tanks on board the visiting LNG carrier need to be filled with gas when the LNG is unloaded. If the onshore/offshore storage tank at the terminal is located far away from where the LNG carrier is moored, a long vapor return line is needed, and the cost for construction of the vapor return line can be high.

The high costs associated with constructing marine LNG terminals has been a significant challenge for the industry over the last 30-40 years, and so there is a need for improved solutions.

Techniques for offloading or loading fluids at locations at sea and remote from shore have been suggested. These can be beneficial in that cargo vessels may not need to travel to shore to offload the fluid. These techniques can have challenges in how to load or offload the cargo reliably, safely and efficiently, and without excessive expenditure or capital requirements. In particular, they need to cope with demands of inclement weather and high-sea states. Conventional moorings can be susceptible to significant rolling motions if wave, wind and currents or swell approach beam-on to the vessel. LNG carriers can be particularly affected by rolling as the LNG containment system (LNG tanks) may be damaged due to LNG sloshing inside the tanks.

In some proposed solutions, LNG may be loaded onto an LNG carrier from an offshore storage facility such as a large spread-moored floating LNG storage unit. The LNG industry has been searching for decades for a solution to be able to safely offload LNG from a spread-moored unit to a conventional LNG carrier, but without much success. As a result, floating LNG storage units which are typically constructed or may be under planning are generally based on using generally costly swivel and turret systems to provide a rotational mooring which allows the unit to weather-vane in order to obtain a more favorable orientation with respect to the prevailing weather direction.

Due to the weather demands it may not be easy to safely connect the necessary tubing to the LNG carrier for loading or offloading LNG. Relative movements between the carrier and the terminal can make it difficult to position the tubing correctly and safely, and make a connection at the cargo manifold of the LNG carrier. The necessary tubing to be connected to the cargo manifold can be very heavy and cumbersome to handle, particularly under dynamic loads as may result from motions of the sea. Thus, there can be a risk of substantial periods of operational downtime.

In addition to the challenges related to lifting and connection of tubing, provisions for handling emergency situations need to be in place to satisfy requirements for LNG terminals. In present solutions, convention has been for the LNG carrier to disconnect and move away from the terminal if needed in the event of an emergency such as a fire or the like.

An example prior art solution is described in the patent publication WO2015/107147 (Connect LNG). This describes a transfer structure which connects onto a side of an LNG carrier at sea by an attachment system which provides for multiple degrees of freedom of movement between the vessel and the transfer structure. The attachment system is described to operate by way of an attractional force created through electromagnets or suction with additional adaptations to allow the freedom of movement sought with respect to the vessel. While this prior art solution might help in certain respects to provide a pipe for transfer of LNG from the vessel to a storage facility, its applicability may be restricted to particular mooring and offloading contexts and may not always be a feasible, efficient, or cost attractive solution. Transit of the transfer structure to the LNG carrier is described to take place through tug or propeller operation.

In light of the above, the present inventors have identified needs for improvement, particularly for improved systems for cargo vessels for offloading or loading fluid cargo with greater operational uptime, safety, simplicity, and/or efficiency. An aim of the invention is to obviate or at least mitigate drawbacks or difficulties experienced in the prior art.

SUMMARY

According to a first aspect of the invention, there is provided a unit for allowing connection of tubing to a cargo vessel for offloading cargo from the cargo vessel to a cargo recipient, the tubing comprising a first portion for connecting between the cargo vessel and said unit and a second portion for connecting between said unit and the cargo recipient, the unit being arranged to be semi-submersible and to travel between a standby location and a position at or adjacent to the vessel in order to obtain the connection and offload the cargo, the unit comprising:

a semi-submersible hull;

at least one lifting and handling device capable of lifting an end of the first portion of the tubing onto the cargo vessel in order to connect the first portion of tubing to the vessel for providing fluid communication between the vessel and the tubing; and at least one reel capable of storing and spooling out part of the second portion of the tubing for adapting an amount of extension of said second portion between the unit and the cargo recipient.

The tubing may comprise a first plurality of tubing portions to be connected to the vessel, and a second plurality of tubing portions to be connected to the cargo recipient. The unit may further comprise at least one conduit for connecting the first plurality of tubing portions with the second plurality of tubing portions, for allowing fluid to be offloaded from the cargo vessel through the first plurality of tubing portions into the conduit and then onward through the second plurality of tubing portions from the conduit to the cargo recipient.

The unit may further comprise at least one device operable to pull in a flexible elongate member which may be anchored to the seabed. The flexible elongate member may be seabed anchored chain. The device may be a spooling device arranged to spool in the flexible elongate member. Typically, the device may be a winch. The unit may include a control system configured to control the device (e.g. the winch) in order to drive the unit between the standby location and the location at or adjacent to the cargo vessel. The unit may be operable at the vessel or in the adjacent location to allow the connection with the vessel to be obtained and the cargo to be offloaded.

The hull may comprise a deck and columns for supporting the deck in the water. The columns may be arranged to intersect a surface of the water, in use.

The lifting and handling device may comprise a crane. The crane may comprise a winch for controlling a cable of the crane. An end of the cable may be provided with a device for coupling the cable to the end of the first portion of the tubing, and the winch may be a constant tension winch arranged to adapt an amount of pay out of the cable for supressing wave motion effects on the position of the end of the cable.

The lifting and handling device may be configured to land the end of the first portion of the tubing on a saddle structure on the cargo vessel at or adjacent to the cargo manifold under control of a winch which may be operable to pay out a cable to suppress wave motion effects on the end of the first portion of the tubing.

The lifting and handling device may comprise an articulated arm extender.

The unit may further comprise a storage tray for storing the first portion of the tubing on the hull during transit.

The cargo may comprise a fluid, such as LNG or LPG. The unit may further comprise a vaporiser for producing vapor from the LNG or LPG being offloaded and may further comprise return tubing for returning the produced vapor to a depleted cargo tank on the cargo vessel.

According to a second aspect of the invention, there is provided a system for offloading cargo from a cargo vessel and delivering the cargo to a cargo recipient, the system comprising:

a cargo vessel which is spread moored at sea to a plurality of mooring points for mooring the cargo vessel in a desired orientation, the cargo to be offloaded from the vessel;

tubing configured to be connected to the vessel for fluid communication between the vessel and the cargo recipient, the tubing comprising a first portion configured to be connected to the cargo vessel and a second portion configured to be connected to the cargo recipient; and a semi-submersible unit operable to travel across the sea and carry part of the tubing from a stand-by location to a position at or adjacent to the cargo vessel, so as to allow an end of the first portion of the tubing to be connected the cargo vessel for offloading the cargo, the unit having at least one lifting and handling device, which when the unit is positioned adjacent to the cargo vessel, is operable for arranging the end of the first portion of the tubing at or near a manifold on the cargo vessel for connection thereto.

The system may further comprise at least one flexible elongate member, e.g. a chain, which may be anchored to the seabed. The semi-submersible unit may be configured to draw in the flexible elongate member, e.g. chain or the like, in order to travel between the stand-by location and the position at or adjacent to the cargo vessel.

The semi-submersible unit may further comprise at least one reel for storing part of the tubing on the reel and paying out to vary an extent of the tubing between the recipient and the unit.

The cargo recipient may comprise a subsea or onshore pipeline arranged to transfer the cargo to an onshore cargo storage facility. The cargo recipient may comprise a pipeline bridge.

The cargo recipient may comprise a storage facility, for example a floating storage vessel.

In the stand-by location and during travel to the position at or adjacent to the vessel, the second portion of the tubing may be connected to the recipient.

In the position adjacent to the vessel, the semi-submersible unit may be urged against a side of the cargo vessel by either or both of: tension applied between the cargo vessel and said unit; and tension applied from said unit to at least one anchored seabed flexible elongate member, e.g. chain or other heavy non-buoyant elongate member.

The system may further comprise a plurality of mooring points for providing the spread mooring of the cargo vessel for allowing the vessel to be moored in a plurality of headings, wherein the cargo vessel may be spread moored to selected ones of the plurality of mooring points in a desired one of the plurality of headings.

The cargo may comprise a fluid such as liquefied natural gas (LNG) or liquefied petroleum gas (LPG). The semi-submersible unit may have a vapor generator for producing vapor from the liquefied gas. The system may include a return line between the vapor generator on the semi-submersible unit and the cargo vessel for transmitting the produced vapor through the return line into a depleted cargo tank of the cargo vessel.

According to a third aspect of the invention, there is provided a method of offloading cargo from a cargo vessel and delivering the cargo to a cargo recipient, the method comprising the steps of:

providing a cargo vessel which is spread moored at sea to a plurality of mooring points in a desired orientation;

operating a semi-submersed unit so as to travel across the sea carrying part of a tubing from a stand-by location to a position at or adjacent to the cargo vessel, the tubing to be connected to the cargo vessel for obtaining fluid communication between the vessel and the cargo recipient, a first portion of the tubing to be connected to the cargo vessel and a second portion of the tubing to be connected to the recipient;

during location of the unit in the position at or adjacent to the vessel, operating a lifting and handling device on the semi-submersed unit to arrange an end of the first portion at or near a manifold on the cargo vessel to allow connection thereto; and connecting the end of the first portion of tubing to the manifold to allow fluid communication through the first and second portions of the tubing and allow the cargo to be offloaded from the cargo vessel through the tubing to the cargo recipient.

Chains or other flexible elongate members may be arranged on the seabed, and the semi-submersed unit may have devices operable to pull in the flexible elongate members. For example, such devices may be spooling devices such as winches which may be connected to the flexible elongate members or chains in order to pull them in. The method may further comprise operating one or more such devices on the semi-submersed unit to draw in the flexible elongate members, e.g. chains, to travel across the sea between the stand-by location and the position at or adjacent to the cargo vessel.

The method may further comprise operating such devices so as to pull on the one or more of the flexible elongate members to urge the semi-submersed unit against a side of the cargo vessel.

The operation of these devices, e.g. winches or other spooling device, may be performed during either or both of connecting the tubing to the manifold of the cargo vessel and offloading the cargo from the vessel through the tubing. Thus, the side of the connection unit may be urged to bear against a side of the cargo vessel by a force imparted due to the operation of the devices pulling on the chains.

According to a fourth aspect of the invention, there is provided a system for offloading cargo from a cargo vessel and delivering the cargo to a cargo recipient, the system comprising:

a cargo vessel which is moored at sea to a mooring point such that the cargo vessel is allowed to rotate about the mooring point in response to weather conditions, the cargo to be offloaded from the vessel;

tubing configured to be connected to the vessel for fluid communication between the vessel and the cargo recipient, the tubing comprising a first portion configured to be connected to the cargo vessel and a second portion configured to be connected to the cargo recipient; and a semi-submersible unit operable to travel across the sea and carry part of the tubing from a stand-by location to a position at or adjacent to the cargo vessel, so as to allow an end of the first portion of the tubing to be connected the cargo vessel for offloading the cargo.

The unit may have at least one lifting and handling device, which when the unit may be positioned adjacent to the cargo vessel, may be operable for arranging the end of the first portion of the tubing at or near a manifold on the cargo vessel for connection thereto.

The unit may be fitted with propellers and steering and positioning systems for operating the propellers to maneuver the unit into the position at or adjacent to the vessel.

The second portion of the tubing may be flexible to allow sufficient movability to move into the position at or adjacent to one side of the cargo vessel in any rotational orientation about the mooring point.

According to a fifth aspect of the invention, there is provided method of offloading cargo from a cargo vessel and delivering the cargo to a cargo recipient, the method comprising the steps of:

providing a cargo vessel which is moored at sea to a mooring point such that the cargo vessel is allowed to rotate about the mooring point in response to weather conditions;

operating a semi-submersed unit so as to travel across the sea carrying part of a tubing from a stand-by location to a position at or adjacent to the cargo vessel, the tubing to be connected to the cargo vessel for obtaining fluid communication between the vessel and the cargo recipient, a first portion of the tubing to be connected to the cargo vessel and a second portion of the tubing to be connected to the recipient; and during location of the unit in the position at or adjacent to the vessel, connecting the end of the first portion of tubing to the manifold to allow fluid communication through the first and second portions of the tubing and allow the cargo to be offloaded from the cargo vessel through the tubing to the cargo recipient.

According to a sixth aspect of the invention, there is provided a unit for allowing connection of tubing to a cargo vessel for loading cargo onto the cargo vessel from a cargo supplier, the tubing comprising a first portion for connecting between the cargo vessel and said unit and a second portion for connecting between said unit and the cargo supplier, the unit being arranged to be semi-submersible and to travel between a standby location and a position at or adjacent to the vessel in order to obtain the connection and load the cargo, the unit comprising:

a semi-submersible hull;

at least one handling device capable of lifting an end of the first portion of the tubing onto the cargo vessel in order to connect the first portion of tubing to the vessel for providing fluid communication between the vessel and the tubing; and at least one reel capable of storing and spooling out part of the second portion of the tubing for adapting an amount of extension of said second portion between the unit and the cargo supplier.

The tubing may comprise a first plurality of tubing portions to be connected to the vessel, and a second plurality of tubing portions to be connected to the cargo supplier. The unit may further comprise at least one conduit for connecting the first plurality of tubing portions with the second plurality of tubing portions, for allowing fluid to be loaded onto the cargo vessel via the conduit from the cargo supplier through the first plurality of tubing portions and the second plurality of tubing portions.

The unit may further comprise at least one device operable to pull in a flexible elongate member which may be anchored to the seabed. The flexible elongate member may be seabed anchored chain. The device may be a spooling device arranged to spool in the flexible elongate member. Typically, the device may be a winch. The unit may include a control system configured to control the device (e.g. the winch) in order to drive the unit between the standby location and the location at or adjacent to the cargo vessel.

The unit may be operable at the vessel or in the adjacent location to allow the connection with the vessel to be obtained and the cargo to be loaded.

According to a seventh aspect of the invention, there is provided a system for loading cargo onto a cargo vessel from a cargo supplier, the system comprising:

a cargo vessel which is spread moored at sea to a plurality of mooring points for mooring the cargo vessel in a desired orientation, the cargo to be loaded onto the vessel;

tubing configured to be connected to the vessel for fluid communication between the vessel and the cargo supplier, the tubing comprising a first portion configured to be connected to the cargo vessel and a second portion configured to be connected to the cargo supplier; and a semi-submersible unit operable to travel across the sea and carry part of the tubing from a stand-by location to a position at or adjacent to the cargo vessel, so as to allow an end of the first portion of the tubing to be connected the cargo vessel for loading the cargo, the unit having at least one lifting and handling device, which when the unit is positioned at or adjacent to the cargo vessel, is operable for arranging the end of the first portion of the tubing at or near a manifold on the cargo vessel for connection thereto.

The cargo supplier may comprise a subsea or onshore pipeline arranged to transfer cargo from an onshore cargo storage facility. The cargo supplier may comprise a pipeline bridge.

The cargo supplier may comprise a storage facility, for example a floating storage vessel.

In the stand-by location and during travel to the position at or adjacent to the vessel, the second portion of the tubing may be connected to the cargo supplier.

In the position adjacent to the vessel, the semi-submersible unit may be urged against a side of the cargo vessel by either or both of: tension applied between the cargo vessel and said unit; and tension applied from said unit to at least one anchored seabed flexible elongate member, e.g. a chain or another heavy non-buoyant elongate member.

According to an eighth aspect of the invention, there is provided a method of loading cargo onto a cargo vessel from a cargo supplier, the method comprising the steps of:

providing a cargo vessel which is spread moored at sea to a plurality of mooring points in a desired orientation;

operating a semi-submersed unit so as to travel across the sea carrying part of a tubing from a stand-by location to a position at or adjacent to the cargo vessel, the tubing to be connected to the cargo vessel for obtaining fluid communication between the vessel and the cargo supplier, a first portion of the tubing to be connected to the cargo vessel and a second portion of the tubing to be connected to the supplier;

during location of the unit in the position at or adjacent to the vessel, operating a lifting and handling device on the semi-submersed unit to arrange an end of the first portion at or near a manifold on the cargo vessel to allow connection thereto; and connecting the end of the first portion of tubing to the manifold to allow fluid communication through the first and second portions of the tubing and allow the cargo to be loaded onto the cargo vessel through the tubing from the cargo supplier.

Chains or other flexible elongate members may be arranged on the seabed, and the semi-submersed unit may have devices operable to pull in the flexible elongate members. The operation of these devices, e.g. winches or other spooling device, may be performed during either or both of connecting the tubing to the manifold of the cargo vessel and loading the cargo onto the vessel through the tubing. Thus, the side of the connection unit may be urged to bear against a side of the cargo vessel by a force imparted due to the operation of the devices pulling on the chains.

According to a ninth aspect of the invention, there is provided a system for loading cargo onto a cargo vessel from a cargo supplier, the system comprising:

a cargo vessel which is moored at sea to a mooring point such that the cargo vessel is allowed to rotate about the mooring point in response to weather conditions, the cargo to be loaded onto the vessel;

tubing configured to be connected to the vessel for fluid communication between the vessel and the cargo supplier, the tubing comprising a first portion configured to be connected to the cargo vessel and a second portion configured to be connected to the cargo supplier; and a semi-submersible unit operable to travel across the sea and carry part of the tubing from a stand-by location to a position at or adjacent to the cargo vessel, so as to allow an end of the first portion of the tubing to be connected the cargo vessel for loading the cargo.

According to a tenth aspect of the invention, there is provided a method of loading cargo onto a cargo vessel from a cargo supplier, the method comprising the steps of:

providing a cargo vessel which is moored at sea to a mooring point such that the cargo vessel is allowed to rotate about the mooring point in response to weather conditions;

operating a semi-submersed unit so as to travel across the sea carrying part of a tubing from a stand-by location to a position at or adjacent to the cargo vessel, the tubing to be connected to the cargo vessel for obtaining fluid communication between the vessel and the cargo supplier, a first portion of the tubing to be connected to the cargo vessel and a second portion of the tubing to be connected to the supplier; and during location of the unit in the position at or adjacent to the vessel, connecting the end of the first portion of tubing to the manifold to allow fluid communication through the first and second portions of the tubing and allow the cargo to be loaded onto the cargo vessel through the tubing from the cargo supplier.

Any of the above aspects of the invention may include further features as described in relation to any other aspect, wherever described herein. Features described in one embodiment may be combined in other embodiments. For example, a selected feature from a first embodiment that is compatible with the arrangement in a second embodiment may be employed, e.g. as an additional, alternative or optional feature, e.g. inserted or exchanged for a similar or like feature, in the second embodiment to perform (in the second embodiment) in the same or corresponding manner as it does in the first embodiment.

Various advantages of the invention and its features are described and will be apparent from the specification throughout.

BRIEF DESCRIPTION OF THE DRAWINGS

There will now be described, by way of example only, embodiments of the invention with reference to the accompanying drawings, in which:

FIGS. 26A to 26F are overhead schematic representations of the system of FIG. 25 with the cargo vessel spread-moored in different orientations with respect to the weather direction;

FIGS. 28A to 28G are overhead schematic representations of the system of FIG. 27 with the cargo vessel spread-moored in different orientations with respect to the weather direction;

DETAILED DESCRIPTION OF THE EMBODIMENTS

Figure 1:
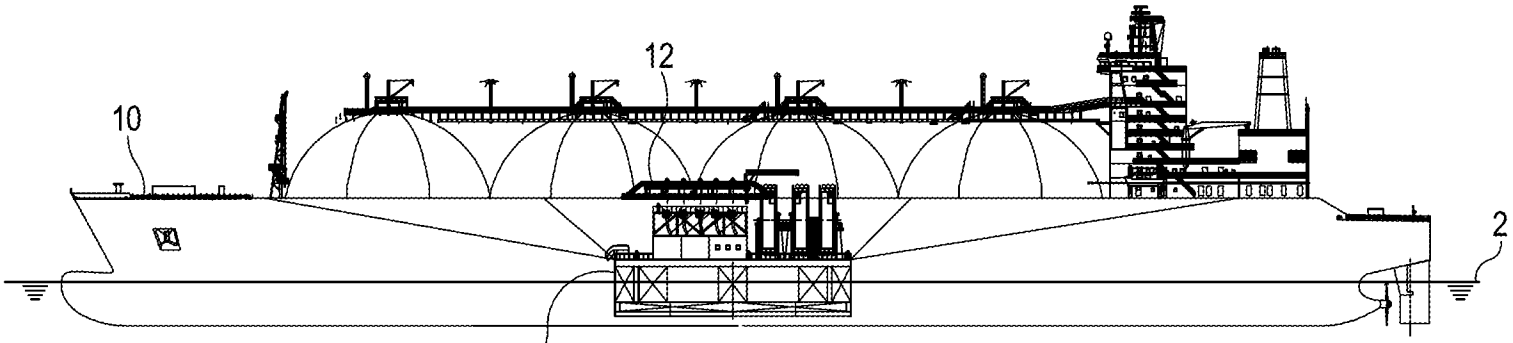
FIG. 1 is a side-on representation of a cargo vessel with a unit moored to the vessel for offloading cargo from the vessel according to an embodiment of the invention.
Figure 2:
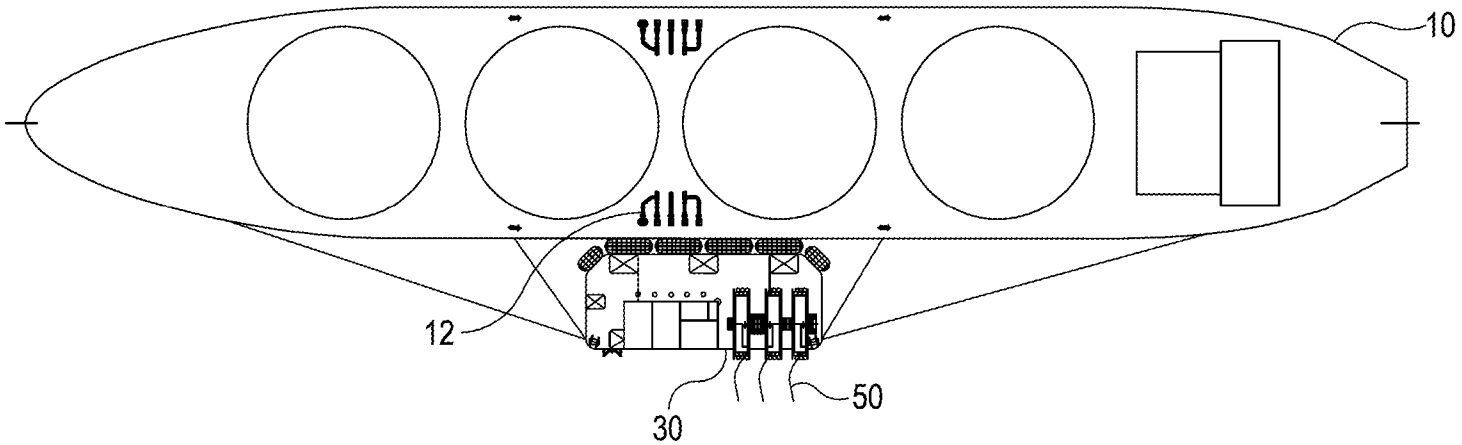
FIG. 2 is a top view representation the cargo vessel and moored unit of FIG. 1.
Figure 3:
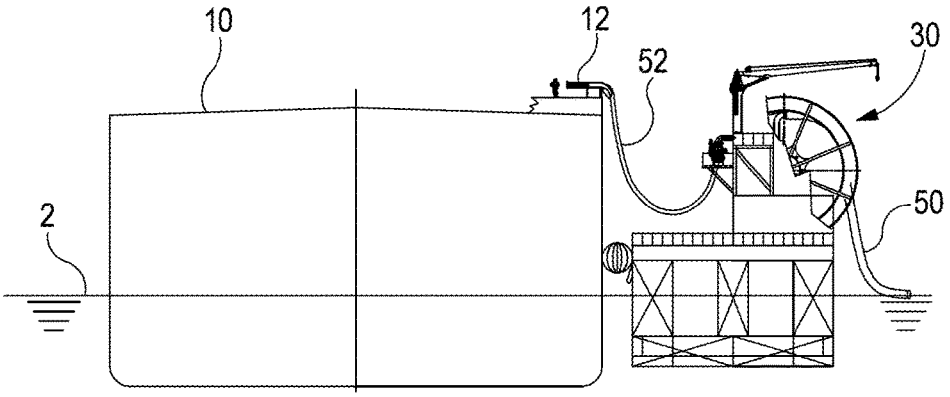
FIG. 3 is an end-on representation of the cargo vessel and moored unit of FIG. 1, in larger scale.

With reference to FIGS. 1 to 2, an arrangement is shown in which a semi-submersible connection unit 30 is positioned adjacent to and moored against a side of a cargo vessel 10 at sea 2. The connection unit 30 is provided for allowing connection of tubing 50 to a cargo manifold 12 on the vessel 10 for offloading cargo from the vessel 10 through the tubing 50 to a recipient facility. The cargo is in this case is fluid in the form of liquefied natural gas (LNG), which is contained in tanks on the cargo vessel 10. The fluid can be extracted from the tanks through the cargo manifold 12. As seen in FIG. 3, a hose 52 is connected to the cargo manifold 12, and the fluid can then pass from the cargo manifold 12 through the hose 52 and the tubing 50 for offloading the fluid from the vessel 10 to the recipient facility.

Figure 4:
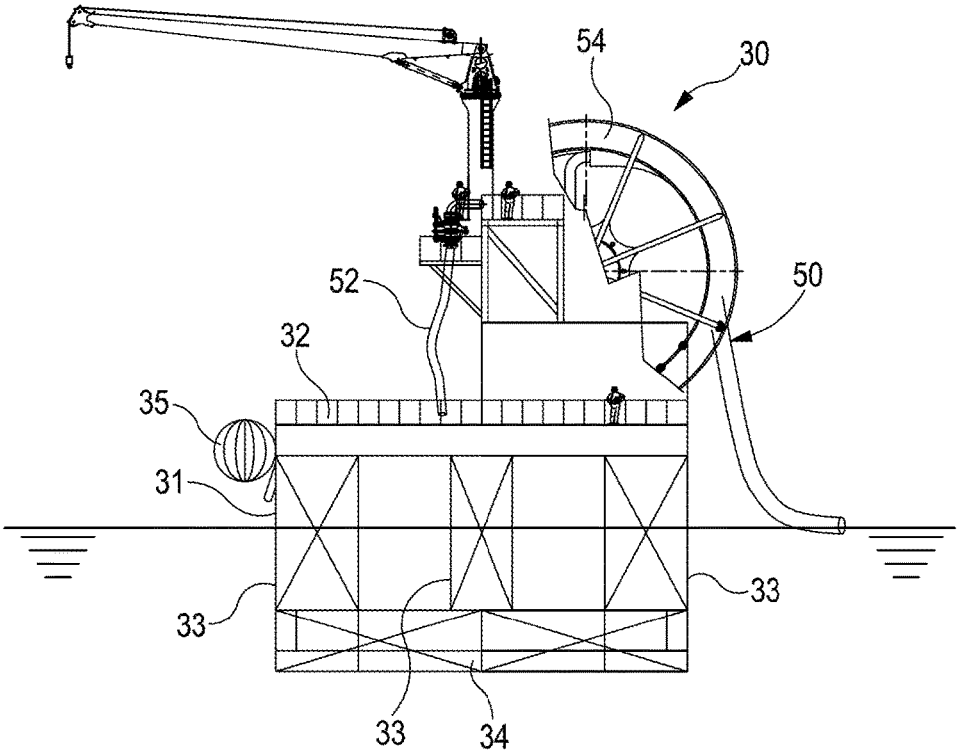
FIG. 4 is an end-on schematic representation of a unit for allowing connection of tubing to a cargo vessel for offloading cargo, according to an embodiment of the invention.
Figure 5:
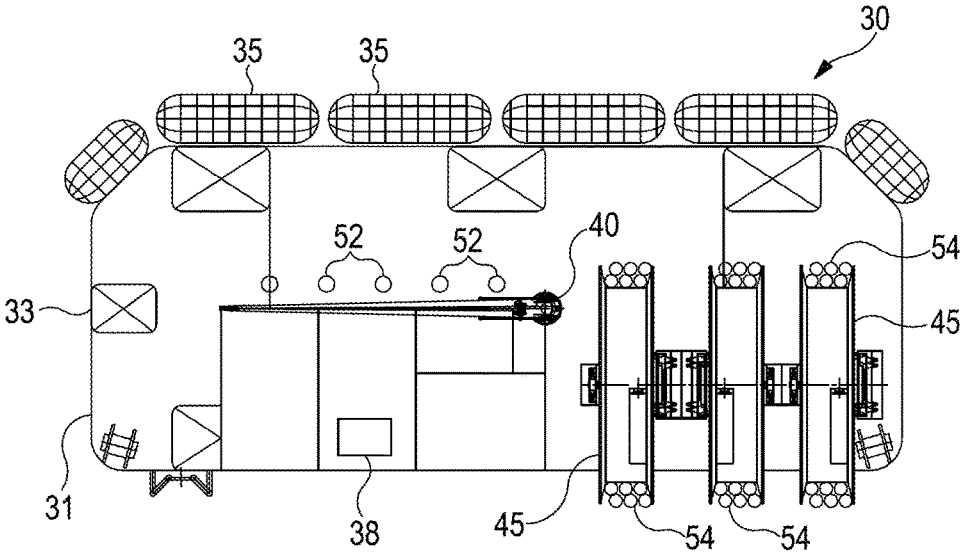
FIG. 5 is a top view schematic representation of the unit of FIG. 4.
Figure 6:
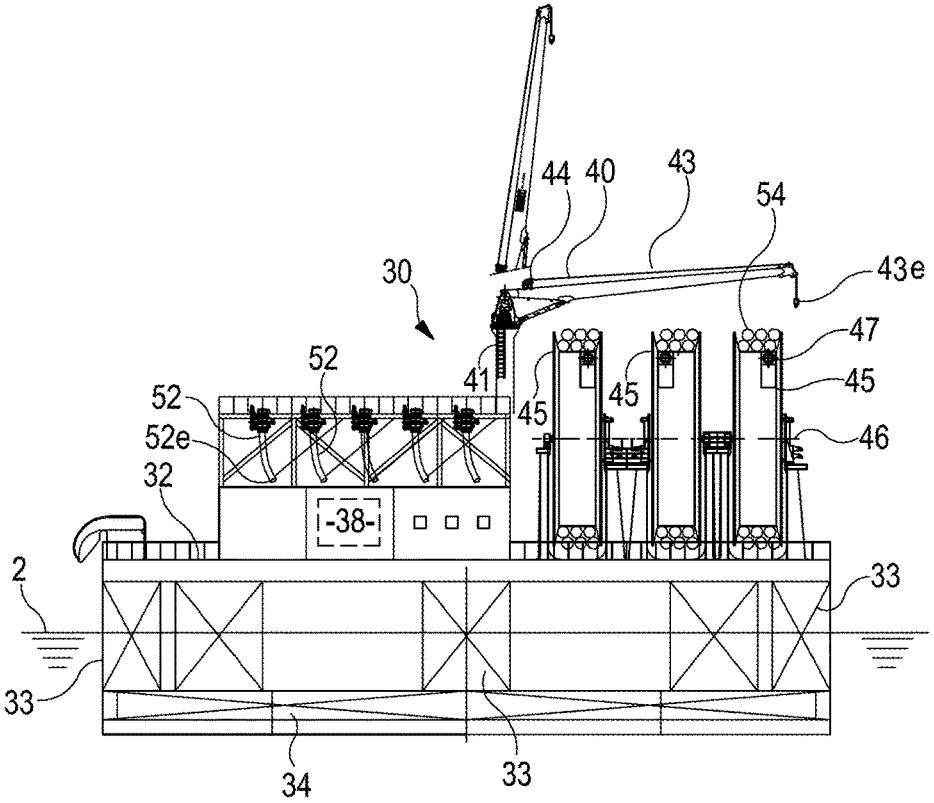
FIG. 6 is a side view schematic representation of the unit of FIG. 4.

With further reference now to FIGS. 4 to 6, the general configuration of the connection unit 30 is illustrated in greater detail. The connection unit 30 has a semi-submersible hull 31. The hull 31 has a deck 32 supported on columns 33 extending through the water surface from a submerged keel 34. The keel 34 is heavily ballasted to provide a low centre of gravity. By way of the low centre of gravity and the small area of intersection provided by the columns where they cross the sea surface, the motion of the connection unit 30 can be highly stable in response to forces imparted from motions of the sea or weather, facilitating the connection of tubing 50 in a wide range of conditions. The keel 34 provides a roll damping effect providing favorable motion characteristics. This can facilitate safe transfer of LNG from the LNG carrier 10 in higher sea states than may be normally achieved such as at onshore terminals, and facilitating high degree of operational up time.

Fenders 35 are provided along the side of the unit 30 so as to be arranged to bear against the side of the cargo vessel 10.

The connection unit 30 is arranged to carry the hoses 52 for connection to the manifold 12 and may typically be arranged on a tray or other designated area on the deck 32 of the connection unit 30 until positioned at or adjacent to the cargo vessel and an end 52*e* of the hose 52 is to be connected onto the fittings of the cargo manifold 12.

In order to connect the hose 52 to the manifold 12 of the cargo vessel 10, the connection unit 30 is further provided with a lifting and handling device, which is in the form of a crane 40 in this example. The crane 40 is arranged to lift the hose 52 from the connection unit 30 and bring the end 52*e* of the hose 52 onto the cargo vessel 10 and land it in position to allow connection of the end 52*e* of the hose to the cargo manifold 12. Personnel on the cargo vessel 10 may fit the hose end 52*e* to the fittings of the cargo manifold 12, e.g. by bolting together mating flanges or the like.

In addition to the hose 52, the tubing 50 for providing fluid connection between the vessel and the recipient facility includes a flexible pipe 54, part of which is spooled onto a storage reel 45 on the connection unit 30. The storage reel 45 is rotatable about a central axis 46 so that the flexible pipe 54 can pay out from the storage reel 45 as the connection unit 30 travels into position adjacent to the cargo vessel 10. One end of the flexible pipe 54 connects onto a connector 47 on a base of the reel 45, and the other end of the flexible pipe 54 connects to the recipient facility. The recipient facility (as will be described further below) may for instance be an offshore access point connecting to a transport pipeline from which the offloaded fluid may be transported to a storage facility. Alternatively, the recipient facility could be an offshore moored storage facility.

The connection unit 30 is arranged with a conduit (not shown) whereby fluid can communicate through the conduit from the hose 52 and into the flexible pipe 54 through the connector 47.

As can be seen, the connection unit 30 shown has five hoses 52 and three reels 45 each with flexible pipe 54 stored thereupon. Any of the hoses 52 can be put in fluid communication with a selected one of the flexible pipes 54. Where the cargo manifold 12 on the vessel 10 allows, multiple hoses 52 may be connected to the manifold 12 and may offload fluid through the hoses 52 in parallel.

In other cases, multiple hoses 52 may be connected with one or more of the hoses 52 being used to offload the LNG, and one or more other hoses 52 used to return LNG vapor to a depleted hold as the offloading of LNG progresses. The connection unit 30 in this example is provided with a vaporizer 38, configured to generate vapor from the LNG gas being offloaded, and to return the generated vapor through a hose 52 via the manifold 12 to the depleted hold. By installing a small LNG vaporizer system on the connection unit 30 that will generate the required gas to backfill the tanks on the LNG Carrier, long distance vapor return pipelines e.g. from a remote terminal can be avoided. The cost for the LNG vaporizer on the connection unit 30 can be moderate.

The connection unit 30 may include all required equipment in order allow a connection of the tubing to be performed to enable offloading of LNG from the LNG carrier 10 to the recipient. A complete connection unit 30 can be pre-built ready to simply be towed to the final location where it is to be employed.

The end of flexible pipe 54 can have a simple interface to the onshore pipeline 81 by standard 20" flange connections. The connection unit 30 can also be readily relocated to another location if the associated LNG terminal should discontinue operations, and it can in principle be applied to any LNG offloading terminal.

The connection unit 30 includes a propulsion system so as to be able to autonomously travel from a stand-by location to the position adjacent to the cargo vessel 10. The propulsion system can take different forms in different embodiments of the invention, as will be described further in the following. It can be desirable however, for the propulsion system to be simple, reliable and cost efficient.

Referring now to FIGS. 7 to 10, the connection unit 30 is shown in use for obtaining a connection between the cargo vessel 10, in this case an LNG carrier, for offloading the LNG to an offshore access point 80 of an LNG transport pipeline 81. The offshore access point 80 is an "LNG pipeline bridge" in this example.

Figure 7:
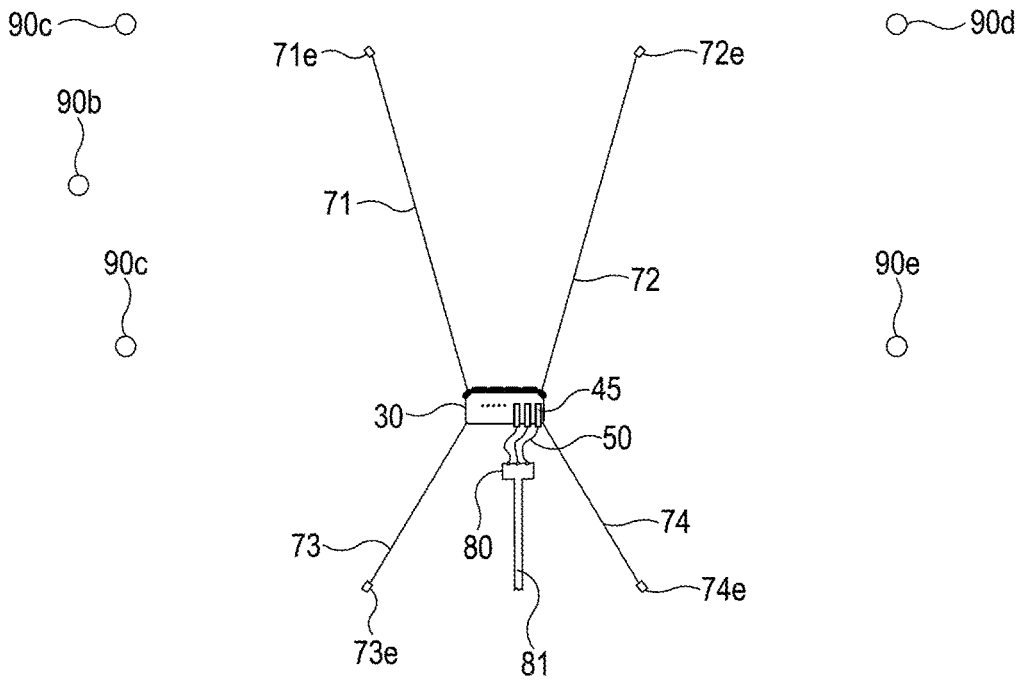
FIGS. 7 to 10 are plan view representations illustrating sequentially steps in a process of obtaining a connection of tubing to a cargo vessel and offloading cargo from the cargo vessel through the tubing to a transport pipeline recipient, according to an embodiment of the invention.

In FIG. 7, the connection unit is 30 is in a stand-by location adjacent to the offshore access point 80 in an "idle" configuration awaiting visitation from the LNG carrier 10. The flexible pipe 54 of the tubing 50 is connected to the access point 80 (e.g. by flange-to-flange pipe connection or similar) for allowing fluid communication from the flexible pipe 54 into the pipeline 81 for allowing offloading LNG from vessel upon subsequent connection to the LNG carrier 10 and transport of LNG through the pipeline 81 to a storage facility e.g. an onshore facility comprising storage tanks, etc. When in this configuration, most of the flexible pipe 54 is spooled in and stored on the reel 45 on the connection unit 30. If preferred, the flexible pipe 54 may be disconnected from the offshore access point while awaiting visitation from the LNG carrier 10, between offloading operations. The flexible pipe 54 may be connected or disconnected to the access point 80 by quick connect or disconnect couplers arranged on the end of the flexible pipe 54. When disconnected, the flexible pipe can be fully reeled in and stored in its entirety on the connection unit 30 while in the idle configuration when in the stand-by location.

Figure 8:
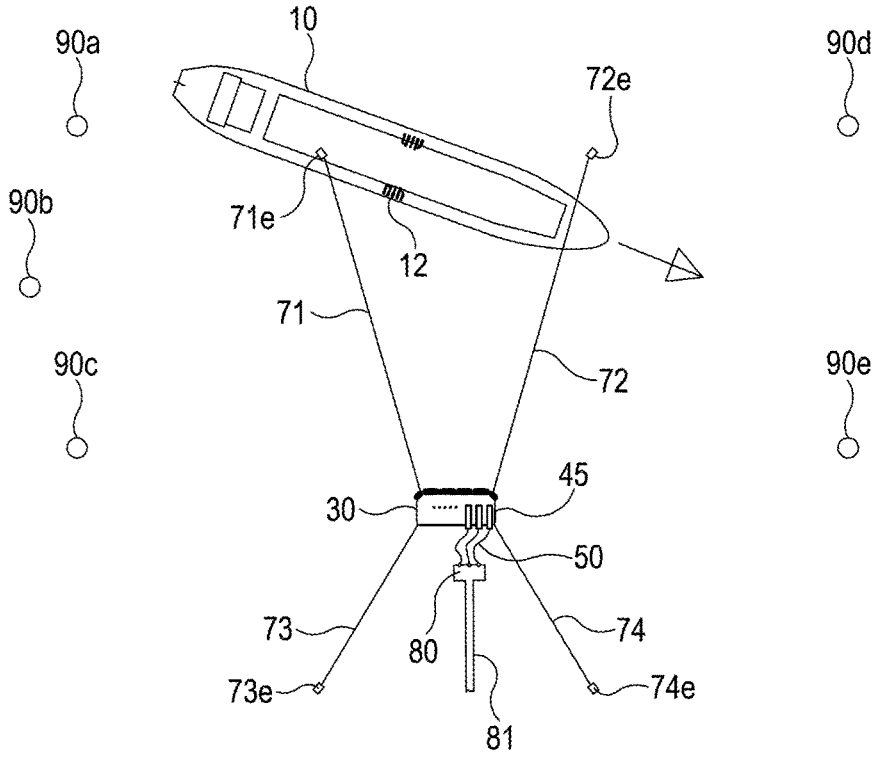

In FIG. 8, the visiting LNG carrier 10 approaches a mooring location between mooring buoys 90*a*-90*e*. The buoys 90*a*-90*e* are anchored to the seabed. The connection unit 30 remains in the stand-by location positioned at a safe distance from the LNG carrier.

Figure 9:
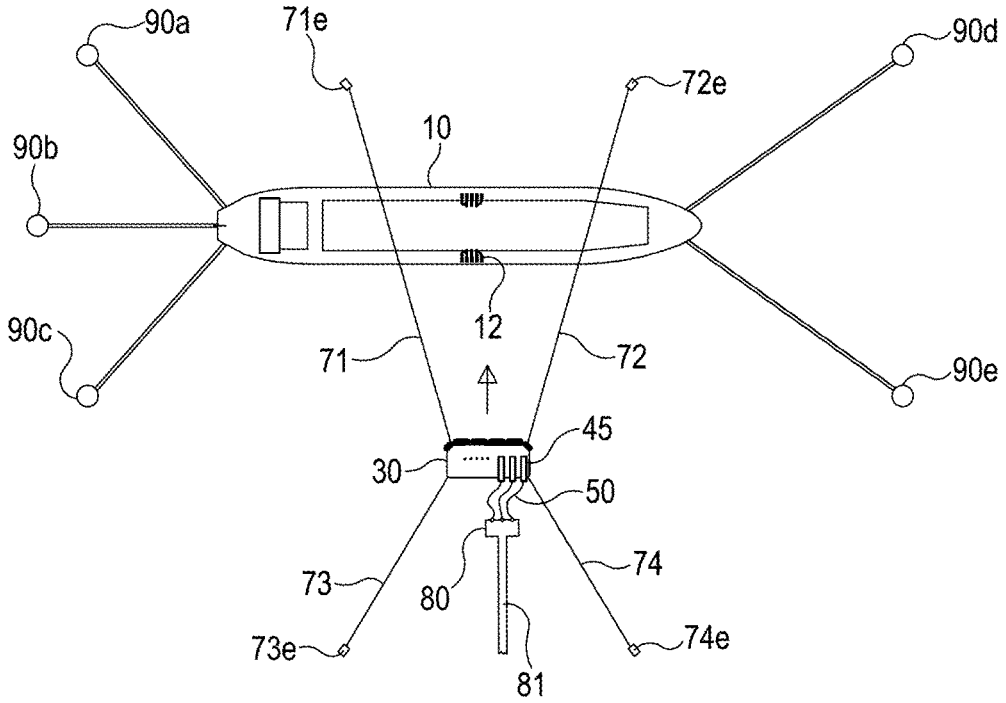

In FIG. 9, the LNG carrier 10 has arrived at the mooring location and is spread-moored to the mooring buoys 90*a*-90*e* so that the LNG carrier 10 is held in substantially fixed orientation at the mooring location. The connection unit 30 travels from the stand-by location toward the LNG carrier 10, as indicated by the arrow. The reels 45 spool out the flexible pipe 54 so as to increase its extension between the offshore access point 80 as the unit 30 travels toward the carrier 10. The flexible pipe 54 is somewhat buoyant so that the length of the pipe 54 between the connection unit 30 and the offshore access point 80 floats in the sea. The flexible pipe 54 may be a hose.

Figure 10:
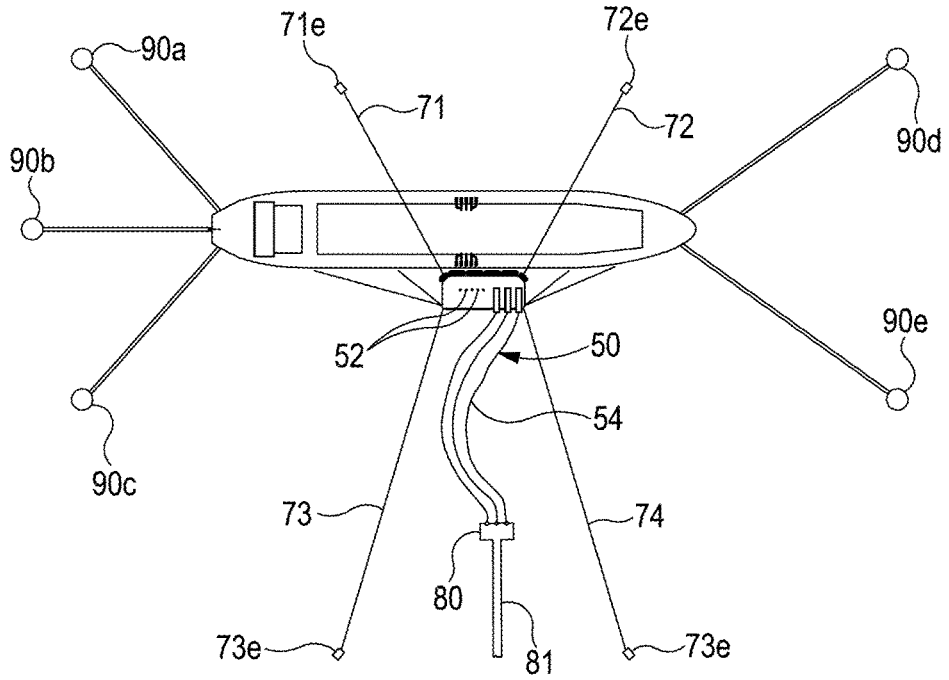
Figure 11:
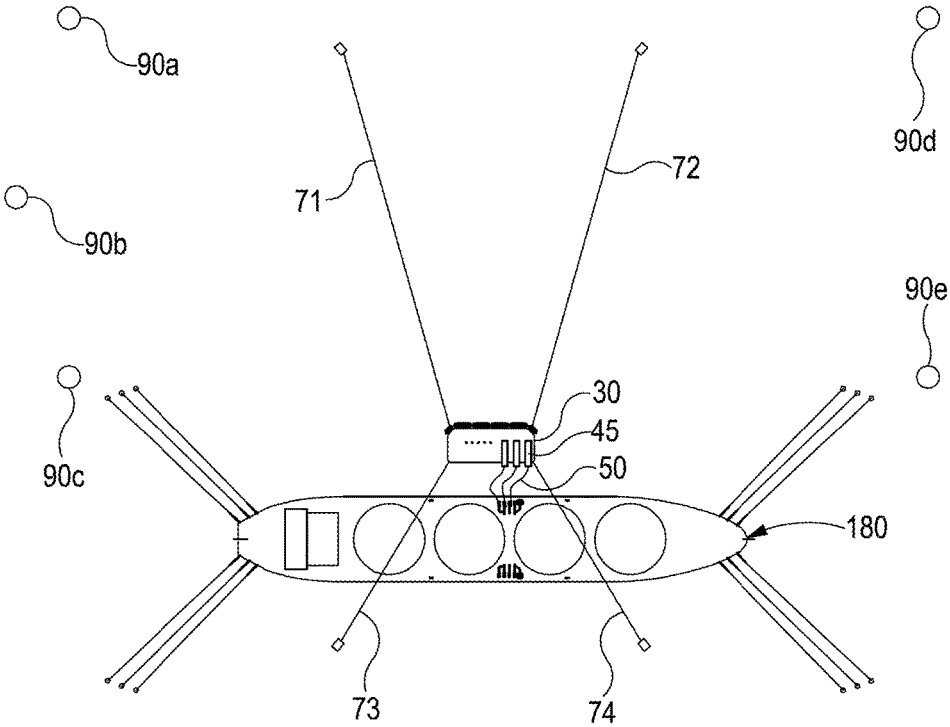
FIGS. 11 and 12 are plan view and end-on view representations respectively of a first step in a process of obtaining a connection of tubing to a cargo vessel and offloading cargo from the cargo vessel through the tubing to a transport pipeline recipient, according to an embodiment of the invention, a unit for allowing connection of the tubing for offloading the cargo located in a stand-by location.
Figure 12:
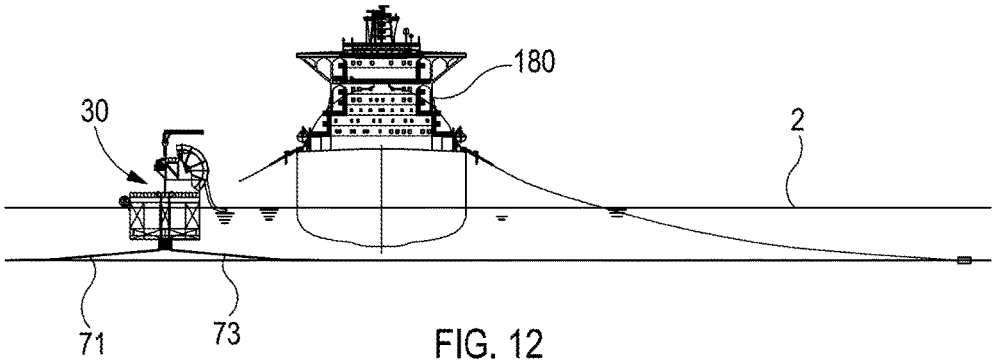
Figure 13:
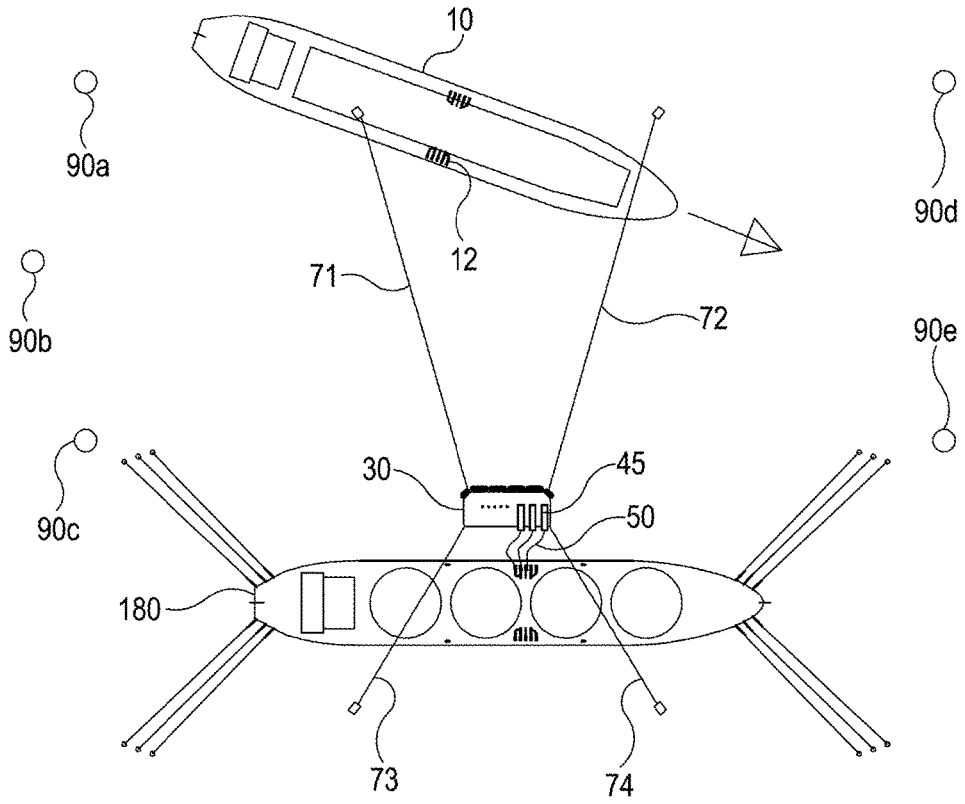
FIG. 13 is a plan view of a next step in the process of FIGS. 11 and 12, the cargo vessel approaching a mooring location.
Figure 14:
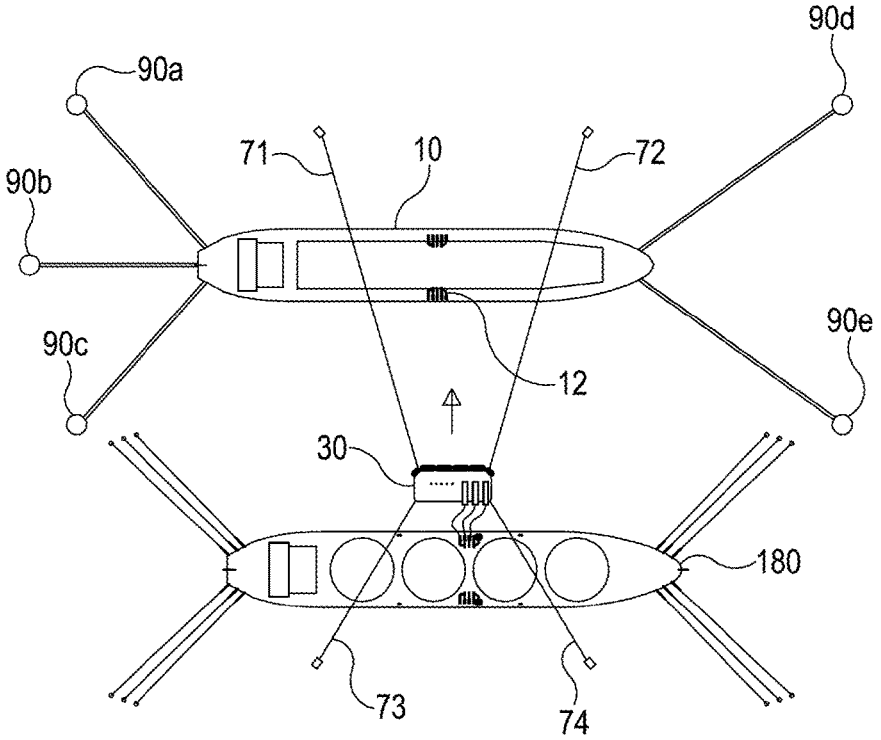
FIGS. 14 and 15 are plan view and end-on view representations respectively of another step in the process of FIGS. 11 and 12, the unit travelling to a position adjacent to the cargo vessel.
Figure 15:
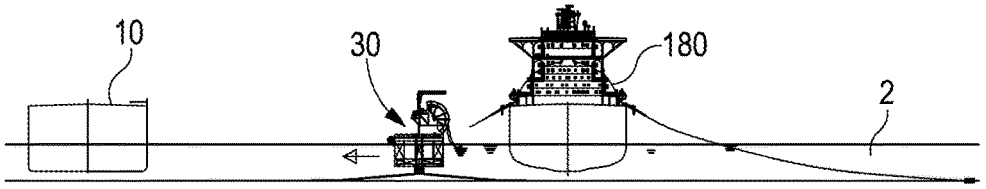

In FIG. 10, the connection unit 30 has arrived at the position adjacent to the LNG carrier 10. In this position, the connection unit 30 is moored to the side of the LNG carrier by mooring lines, which are tensioned to hold the connection unit 30 against the side of the LNG carrier 10. The lifting and handling device 40 on the connection unit 30 is applied as described above to lift and land the ends of the hoses 52 onto the LNG carrier 10 for allowing connection of the hoses 52 to the cargo manifold 12. Once complete, fluid communication through the whole system from the LNG tanks on the LNG carrier 10 through the tubing 50 (via hoses 52 and flexible pipe 54) to the pipeline 81 can be provided.

The offloaded LNG can then be fed to the onshore storage facility downstream from the pipeline 81. After mooring and connecting the hoses 52 to the LNG carrier 10, the connection unit 30 may be left unmanned while LNG is offloaded and fed to the pipeline 81. Monitoring and control of the offloading operation can be carried out remotely from a nearby standby vessel or from the bridge of the LNG carrier 10.

In this example, the connection unit 30 has a "chain-crawling" propulsion system for travelling across the sea 2 toward the cargo vessel 10. For this purpose, a number of seabed anchored chains 71, 72, 73, 74 are provided in the region between the mooring location and the stand-by location. Ends 71*e*, 72*e*, 73*e*, 74*e* of respective chains 71-74 are anchored to the seabed. The connection unit 30 is configured to pull itself along the chains 71-74 to move along the chains into position. The connection unit 30 has spooling devices for instance winches, which can operate to spool in the chains 71-72 to tension the relevant chain between the connection unit 30 and the anchor. In order to move as indicated in FIG. 9, the winches connected to chains 71 and 72 may be provided to spool in the chains 71 and 72 while winches connected to chains 73 and 74 may be allowed to spool out. The winches may be controlled by a winch controller to apply the appropriate spool-in and or spool-out for allowing the connection unit 30 to travel toward the vessel 10 and be positioned in the appropriate orientation adjacent to the side of the cargo vessel 10. By independent operability and differential spooling of the winches, i.e. applying different amounts of spooling of one winch as compared with another, the orientation and position of the connection unit 30 can be controlled. In the stand-by location, the chains 71-74 may be engaged so that the connection unit 30 is kept in position, safely away from the mooring location for the LNG carrier 10. Alternatively or in addition, mooring lines from the ATS to the offshore access point 80 and/or to nearby buoys may be used to moor the ATS in place at the stand-by location at the access point 80.

It can be appreciated in the FIGS. 7 to 10 that the chains 71-74 track on or close to the seabed in the area of the mooring location for the LNG carrier 10 such that as the LNG carrier 10 approaches there is plenty of clearance for the LNG carrier 10 in the water column above the chains 71-74 so as to avoid interfering with the chains 71-74.

In FIGS. 11 to 17, the connection unit 30 is applied in the same manner as described above (in FIGS. 7 to 10) except in the example of FIGS. 11 to 17, it is shown in use for obtaining a connection between the LNG carrier 10 and a recipient in the form of an offshore floating LNG storage facility 180 rather than the pipeline access point 80.

Figure 16:
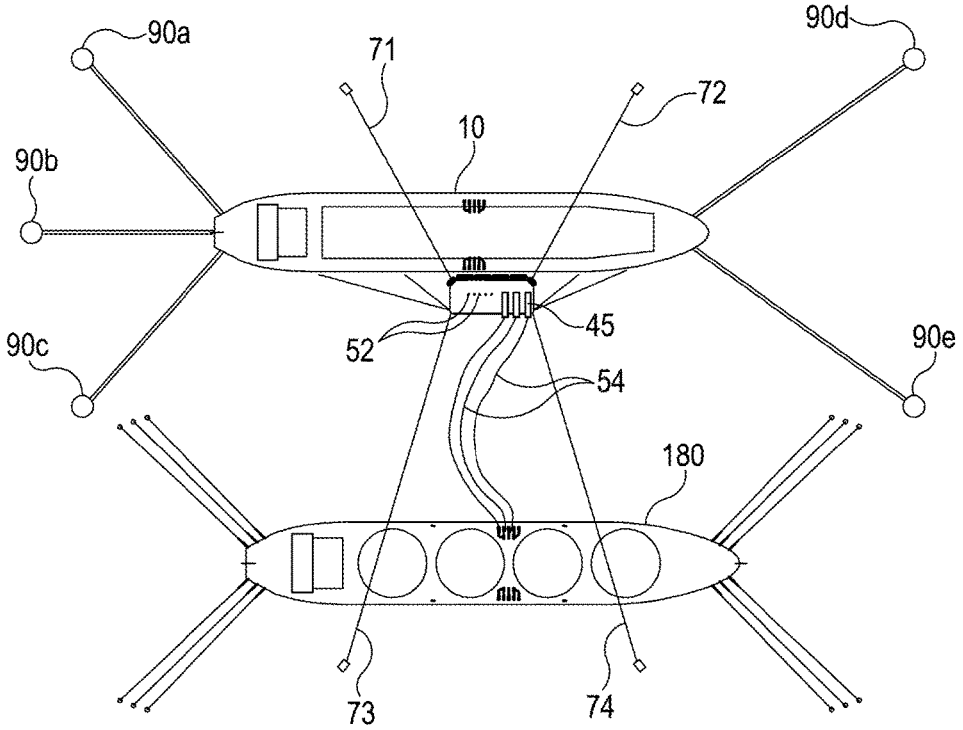
FIGS. 16 and 17 are plan view and end-on view representations respectively of another step in the process of FIGS. 11 and 12, the unit positioned adjacent to the cargo vessel and the tubing connected to the vessel for offloading.
Figure 17:
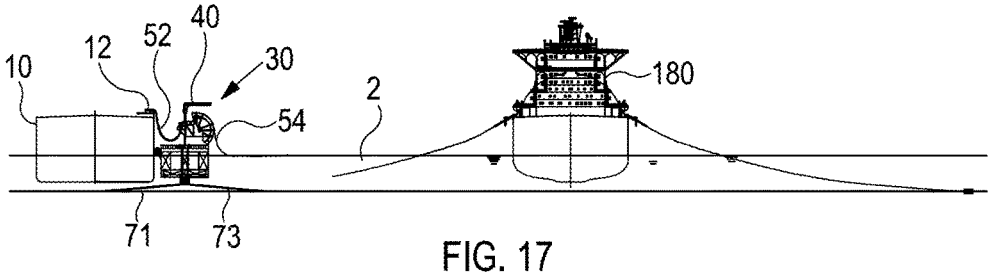

The connection unit 30 is arranged initially in a stand-by location adjacent to the storage facility 180 as seen in FIG. 7. The flexible pipe 54 is connected to the mid-ship cargo manifold of the storage facility 180 for allowing fluid communication from the flexible pipe 54 into the storage tanks of the storage facility upon commencement of offloading from a visiting LNG carrier 10. Once the connection unit 30 has travelled into position adjacent to the LNG carrier 10 and the hoses 52 are connected for offloading, as seen in FIGS. 16 and 17, fluid communication from the LNG carrier 10 to the LNG storage facility 180 is established through the hoses 52 and flexible pipe 54, and the LNG can be offloaded from the LNG carrier 10 and transmitted through the tubing to the storage facility 180. Both the LNG carrier 10 and the LNG storage unit 180 are spread moored in fixed orientations.

Figure 18:
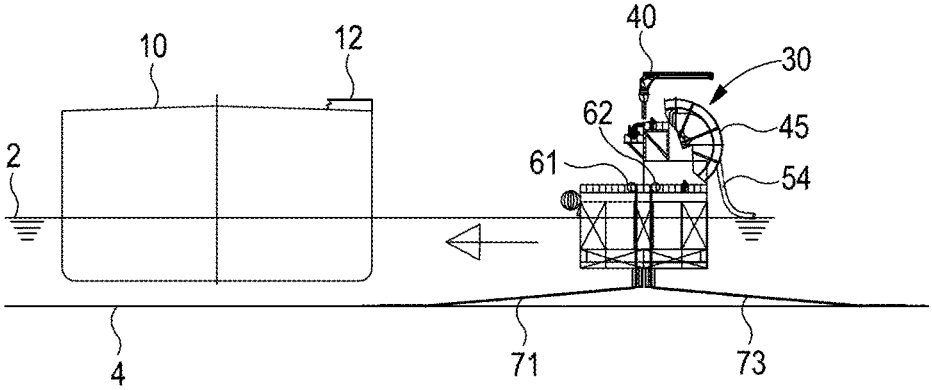
FIGS. 18 and 19 are end-on view sequential representations of the unit using an anchored chain for moving the unit toward its position adjacent to the cargo vessel, in the process of FIGS. 11 and 12 or FIGS. 1 to 10, in larger scale.
Figure 19:
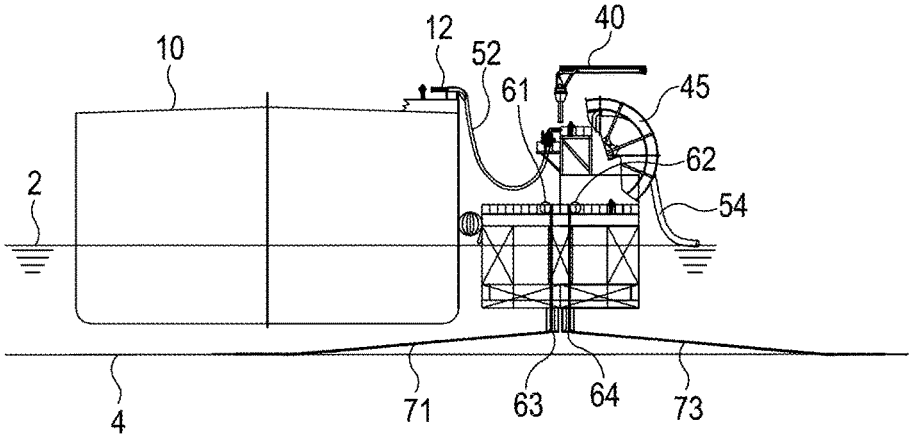

FIGS. 18 and 19 illustrate the "chain crawling" system in greater detail. The connection unit 30 has spooling devices 61, 62 for spooling the seabed-anchored chains 71 and 73 in or out. The spooling devices 61, 62 are arranged on the deck of the connection unit 30 and the chains 71, 73 pass from the seabed 4 upward through respective passageways 63, 64, e.g. fair leads, inside a vertical column of the hull. The outlet for the chains from the connection unit is thus in the bottom of the hull. This arrangement facilitates to keep the chains tracking close to the seabed, while efficiently transferring the spooling force into movement of the connection unit 30 laterally in the desired travel direction. In particular variants, the outlets for the chains may be provided on a section of the passageway which can be extended up or down from the base of the hull to position the outlets close to the seabed. If moving to shallower water, the outlet can be raised, or in order to keep the outlet and the chains close to the seabed when moving into deeper water, the outlet can be lowered. Keeping the outlet close to the seabed can help to reduce risk of interference with the mooring of the LNG carrier 10.

In order to move in the direction indicated in FIG. 18, the spooling device 61 is spooled to pull in and tension the chain 71, while the spooling device 62 is spooled out correspondingly to allow the connection unit 30 to travel toward the LNG carrier 10. It will be appreciated by pulling in on the chain 72 and letting the spooling device 61 spool out, the connection unit 30 can be driven to move in the opposite direction. Thus, the connection unit 30 can in general travel toward and away from the LNG carrier 10, e.g. back to the stand-by location after an offloading operation is complete.

The chain crawling system can provide for efficient self-positioning of the connection unit 30 without use of any propellers or assisting vessels.

In particular embodiments, the connection unit 30 may have a chain winch installed in each corner (in top view) of the connection unit 30. By increasing the hydraulic pressure for a selected one of the winches (the winch being hydraulically operated), the selected winch can start pulling in the chain while one or more of the other winches may pay out automatically by lowering the hydraulic pressure of the other winch(es). Thus, the overall operation of the chain crawling system can be simple and implementable without the need for any advanced control and monitoring system.

Figure 20:
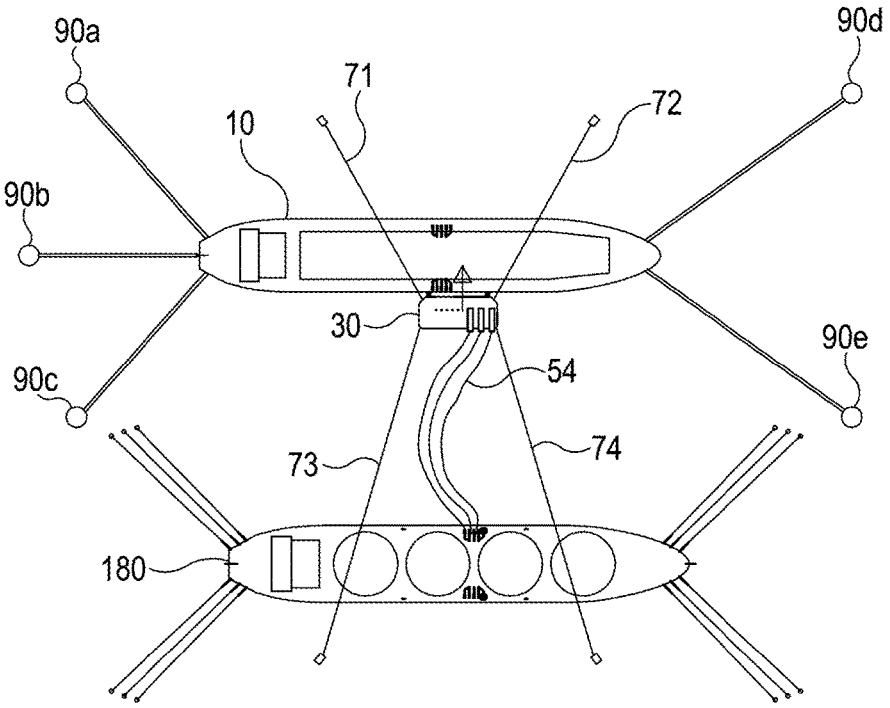
FIGS. 20 and 21 are plan and end-on views respectively of the unit using an anchored chain for urging the unit against a side of the cargo vessel to maintain the unit in position, in the process of FIGS. 11 and 12 or FIGS. 1 to 10.
Figure 21:
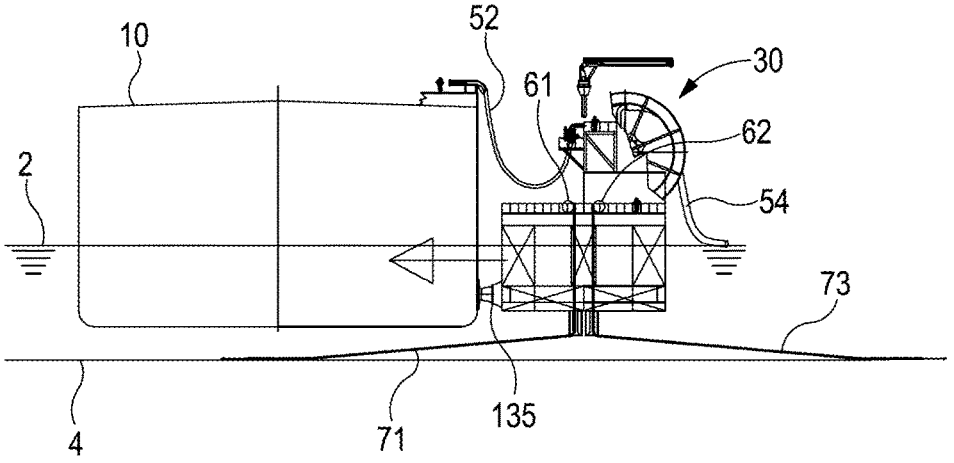

In FIGS. 20 and 21, an alternative configuration of the connection unit 30 is shown with respect to the manner in which the connection unit 30 maintains the position against the side of the LNG carrier 10 when in use such as described above. In this example, the connection unit 30 is urged to bear against the side of the LNG carrier 10 by way of utilising the chains and spooling devices. By pulling in and tensioning the chain 71 using the spooling device 61, the connection unit 30 applies a force against the side of the vessel 30 so as to keep the unit 30 positioned against it. In the presence of movement of the LNG carrier 30 due to currents or weather conditions, variations in the force and tension of the chain 71 may be experienced. A change in tension can be detected and used to control the spooling device 61 to adjust the spooling and tension in the chain appropriately to maintain the force against the side of the LNG carrier 10 and keep the connection unit 30 positioned. The spooling device 61 may be in the form of a constant tension winch and control system in order to provide such functionality. In this example, the connection unit 30 may be provided with a buffer fender 135 arranged below the water line to bear against a side of LNG carrier low down on the hull. This arrangement may facilitate motion stability when the chain 71 is tensioned. In this example, it may not be necessary to use tensioned mooring lines between the connection unit 30 and the LNG carrier 10.

Figure 22:
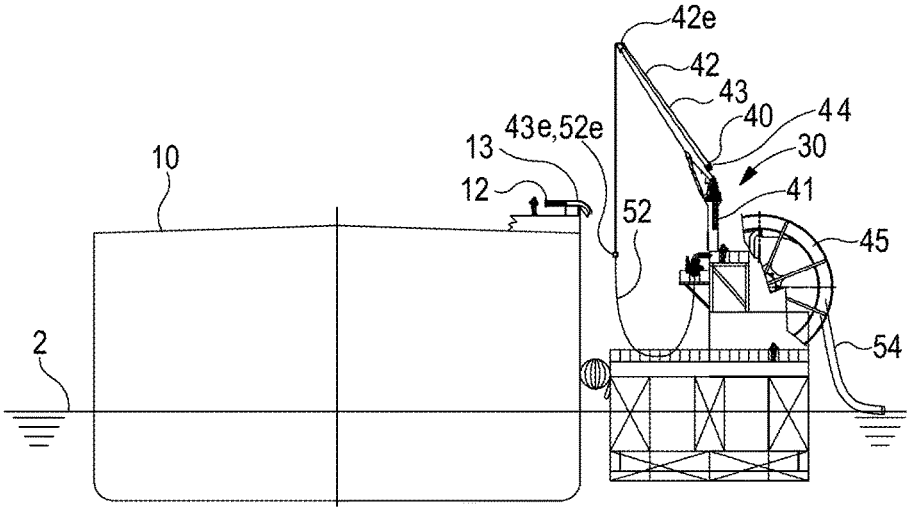
FIGS. 22 and 23 are end on view representations in larger scale of the unit during use in lifting the tubing to be connected to the cargo vessel in the process of FIGS. 11 and 12 or FIGS. 1 to 10.
Figure 23:
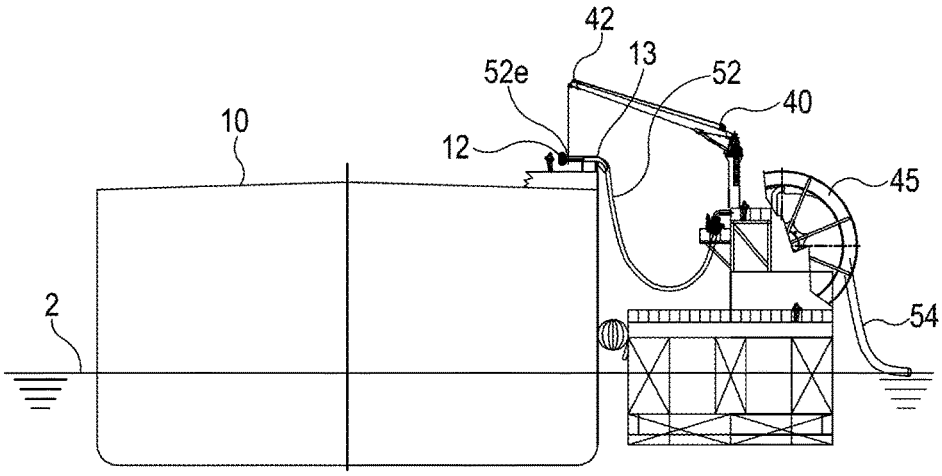

In FIGS. 22 and 23, the manner in which the crane 40 is utilized to obtain a connection of the hoses 52 to the cargo manifold 12 on the LNG carrier 10 is illustrated. First, it can be seen that the crane 40 has a base tower 41 and a boom 42 rotationally connected to the tower 41 so that it can be operated to rotate about a vertical axis and tilt about a horizontal axis in order to position an end 42 *e* of the boom 42 appropriately. The crane 40 has a winch 44 from which a cable 43 is passed over the end 42*e* of the boom. As seen in FIG. 22, an end 43*e* of the cable 43 is connected to the hose 52 and hoists the end of the hose 52 off the deck of the connection unit 30. With the hose 52 attached to the cable 43, the boom 42 and the winch are operated to maneuver the hose 52 and land the end 52*e* of the hose 52 onto a saddle structure 13 in front of the cargo manifold 52, as seen in FIG.

23. Once landed, the end 52*e* of the hose 52 can be fitted to the manifold 12. Relative movements between the LNG carrier 10 and the connection unit 30 such as may occur due to currents or weather, can be experienced and be detected as variations in tension in the cable of the crane. By detecting a change in the tension, the winch can be controlled to pay out or in to adapt the amount of extension of the wire and the position of the end of the hose 52 despite the relative movements. The winch may be a constant tension winch for providing such functionality. The end of the hose 52 may therefore be positioned and landed softly and safely at the manifold 12 even in harsh weather conditions even where large relative movements may take place. Once landed on the saddle structure, relative motions between the vessel and connection unit 30 may be accommodated by the slack and flexibility of the hose 52.

In another variant, multiple hose ends 52*e* may be lifted simultaneously by the crane 40 onto saddle structure 13. The crane 40 may have an attachment on the end of the cable for allowing the multiple hoses 52*e* to be combined and lifted together.

By way of the lifting and handling device 40 in this way, the heavy LNG hoses 52 may be safely be connected to the mid-ship manifold 12 on a LNG carrier without requiring any modification to the crane or other equipment on the LNG carrier. The use of a constant tension winch on the crane 40 makes it possible to safely land the hoses 52 on the saddle structure 13 on the LNG carrier in a controlled manner and may facilitate safe and controlled connection and disconnection of the hoses (e.g. an emergency disconnect).

LNG vessels may generally also not have the means for lifting and handling tubing safely to allow connection to the cargo manifold. For example, the mid-ship crane on conventional unmodified prior art LNG carriers may typically have limited capacity (e.g. 5 ton), limited reach, and may typically not be approved for dynamic loads from wave motions. The connection unit 30 can thus reduce or eliminate need for relying on specific configurations of the LNG vessel in order to obtain the connection.

Figure 24:
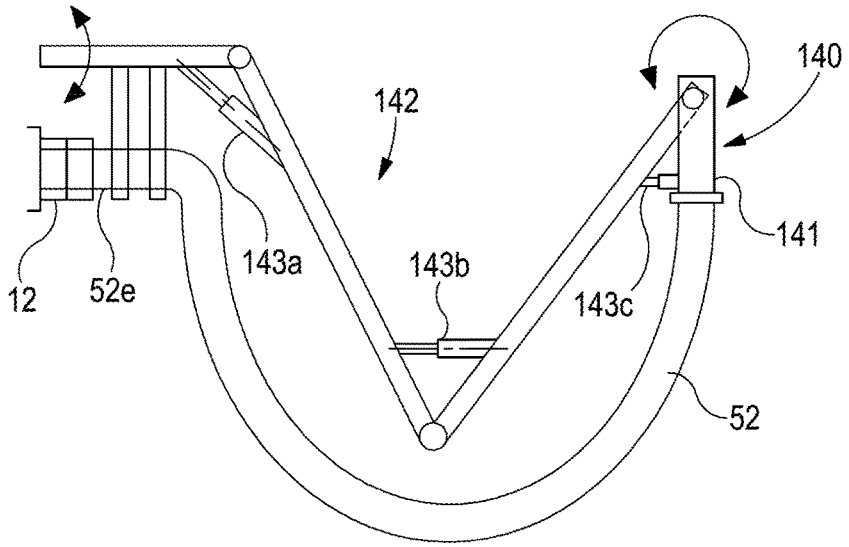
FIG. 24 is a side schematic representation of an alternative handling means for lifting the tubing, according to another embodiment.

In FIG. 24, an alternative lifting and handling device 140 is shown. The device 140 has a tower 141 arranged to be connected to the connection unit 30. The tower 141 is rotatable like that of the crane example. The device 140 has an articulated extender 142 provided for manipulating the end 52*e* of the hose 52. As seen in FIG. 24, the end 52*e* of the hose 52 is connected to an end arm section of the extender 142. The extender 142 has several arm sections arranged to close or open mutually with respect to one another by operation of actuators 143*a*-143*c* to vary the horizontal and/or vertical reach of the extender from the connection unit 30. Two of the adjacent sections form a V-shape, with the intervening angle arranged to open or close by operation of the actuator 143*b* to vary the amount of extension of the actuator between the sections.

Figure 25:
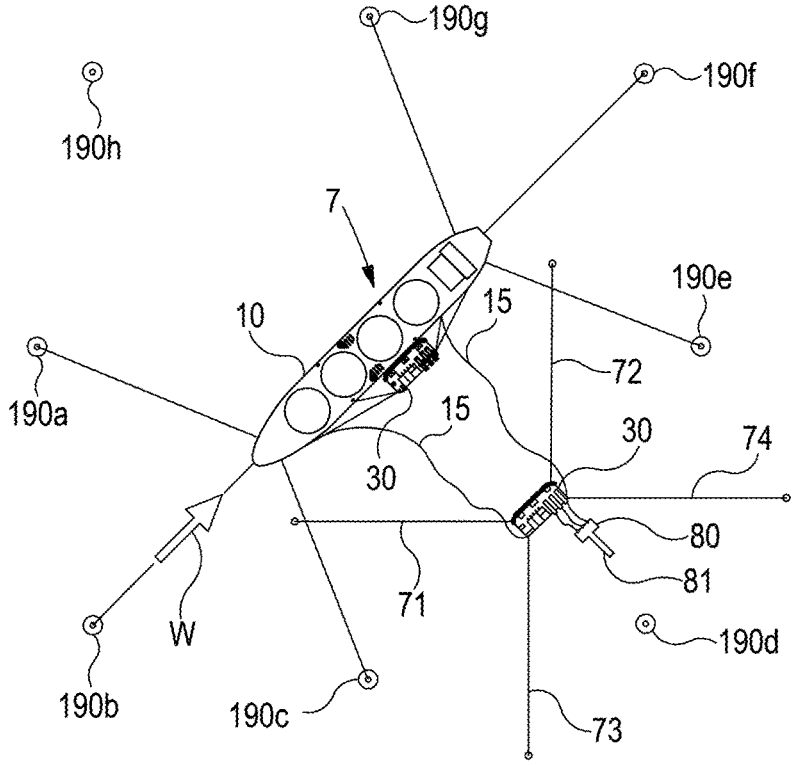
FIG. 25 is an overhead schematic representation of a system for offloading cargo from a cargo vessel and delivering the cargo to a pipeline recipient where the cargo vessel is spread moored, according to an embodiment of the invention.

Turning now to FIG. 25, an "octagon mooring system" is shown. The visiting LNG carrier 10 is spread-moored in a mooring location 7 encircled by mooring points 190*a*-190*b*. The LNG carrier 10 is moored however using only a sub-set of the mooring points, in this case by tension lines extending from the vessel to the mooring points 190*a*-190*c*, and 190*e*-190*g*. The mooring points 190*d* and 190*h* are not used. By appropriate selection of mooring points, the LNG carrier 10 can be positioned in an orientation as shown in FIG. 25 whereby the bow end of the LNG carrier 10 points toward the weather direction as indicated by the arrow W. The weather direction may be the prevailing wind, current, and/or wave propagation direction. This can assist in improving the motion characteristics of the LNG carrier 10 so as reduce effects of motion when the connection unit 30 is applied and offloading of the LNG takes place. The mooring points 190*a*-190*g* are in the form of buoys anchored to the seabed.

It can be seen in FIG. 25 that seabed-anchored chains 71-74 are pulled in using chain winches on the connection unit 30 to move the connection unit 30 toward the LNG carrier 10. However, the final part of travel of the unit 30 into position adjacent to the LNG carrier 10 is carried out through pull-in lines 15. The pull-in lines 15 are cast or shot out from the LNG carrier 10 to the connecting unit 30 and connected. The pull-in lines 15 are then pulled in from the LNG carrier 10 on winches or the like to bring the connection unit 30 into position.

It can be appreciated that FIG. 25 shows the position of the connection unit 30 both in the stand-by location at the offshore access point 80 and the position adjacent to the LNG carrier (although it will not in practice be in both places at the same time).

In FIGS. 26A to 26F, different mooring orientations for the visiting LNG vessel 10 are shown. The arrangement of multiple mooring points 190*a*-190*h* (in an octagon) provides for selecting spread-mooring buoys of the vessel with the bow end pointing toward a range of different headings, specifically 0, 45, 90, 180, 225 and 270 degrees, as indicated. Thus, the vessel can be moored with the bow toward any of the mooring points surrounding the mooring location 7, and the appropriate one can be selected according to the weather direction W. Some additional flexibility in heading can also be obtained by slacking and tensioning of the mooring lines on the starboard and port sides of the LNG carrier 10. A different number of mooring lines 16 from that indicated may be used in order to spread moor the LNG carrier 10. The octagon arrangement can provide significant improvements in operational uptime and regularity for offloading LNG at locations exposed to waves and swell, since the vessel may be moored at several headings and at headings which are more optimal with respect to the incoming wave direction.

Figure 27:
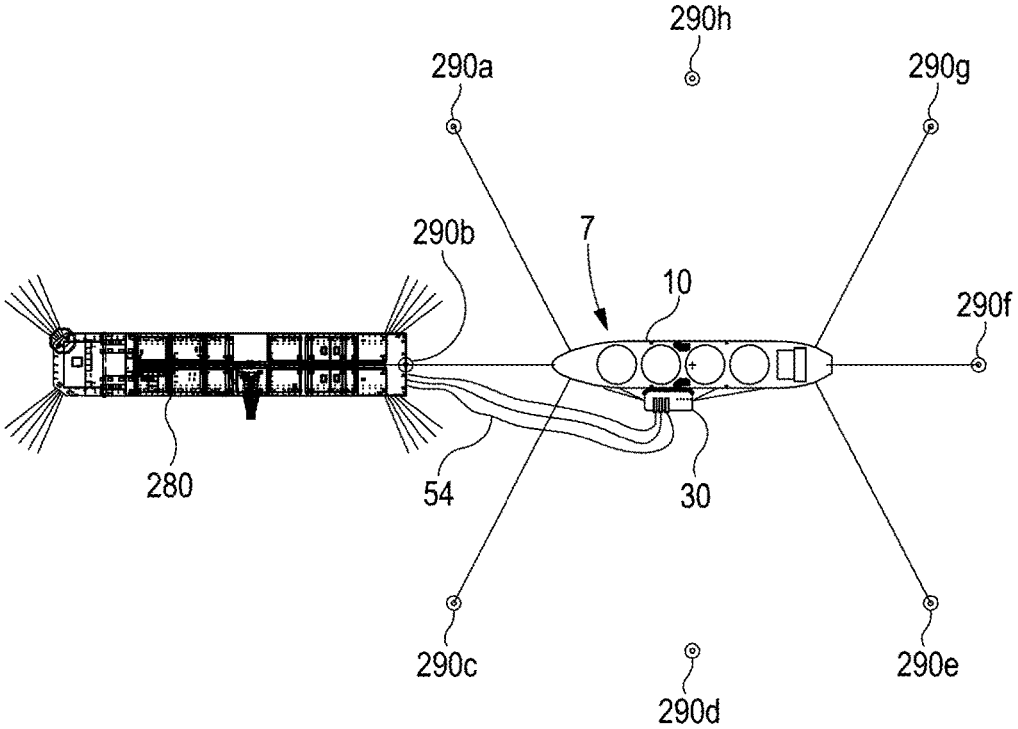
FIG. 27 is an overhead schematic representation of a system for offloading cargo from a spread-moored cargo vessel and delivering the cargo to a spread-moored storage recipient, according to an embodiment of the invention.

Another variant is illustrated in FIG. 27, where the LNG carrier 10 is spread-moored in a particular orientation with the bow toward the mooring point 290*b* and mooring lines engage a selection of the fixed mooring points 290*a*-290*h*. As can be seen mooring points 290*a*-209*c*, and 290*e*-290*f* are occupied, while the mooring points 290*d* and *h* are vacant. In this example, the recipient of the LNG to be offloaded is an offshore storage facility 280. The storage facility 280 may for instance a LNG storage or production unit like a FLNG unit or similar. The mooring points 290*a*, and 290*c*-290*h* are in the form of seabed-anchored buoys, but it can be seen that the mooring point 290*b* is provided by the offshore storage facility itself which is also spread-moored in substantially fixed orientation. The connection unit 30 travels from a location at the storage facility 280 to a position adjacent to the LNG carrier as seen in FIG. 27, where it is then used to connect the hoses 52 to the cargo manifold 12. The flexible pipeline 54 floats in the water, between the connection unit 30 and the offshore storage facility 280. Instead of "chain crawling", the connection unit 30 in this variant is fitted with alternative means of propulsion and steering in order to travel to the LNG carrier 10, such as for instance propellers driven by a motor and controlled by a positioning system, e.g. dynamic positioning, in order to place the connection unit 30 in the appropriate position and orientation adjacent to the LNG carrier 10. Rudders or differential control of the propellers may be used to turn and steer the connection unit 30.

In FIGS. 28A to 28F, different mooring orientations for the visiting LNG carrier 10 are shown. The arrangement of multiple mooring points 290*a*-290*h* (in an octagon) provides for selecting spread-mooring buoys of the LNG carrier with the bow end pointing toward a range of different headings, as indicated, e.g. based on weather, wind or wave propagation directions. Thus, the LNG carrier 10 can be moored with the bow toward any of the mooring points 290*a*-290*h* surrounding the mooring location 7. Some flexibility in heading can be obtained by slacking or tensioning of the mooring lines on starboard and port sides of the vessel accordingly.

Figure 29:
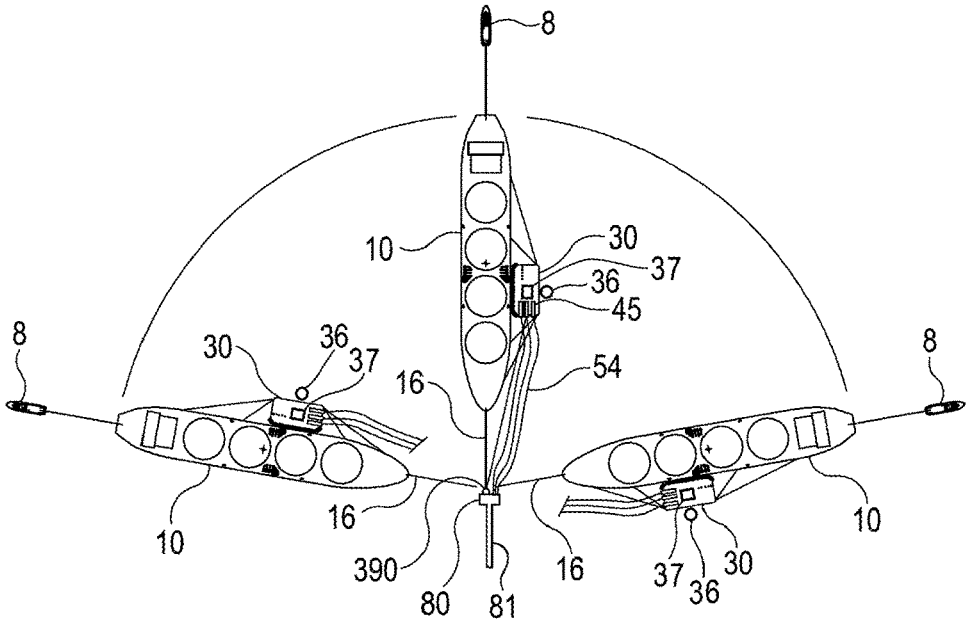
FIG. 29 is an overhead schematic representation of a system for offloading cargo from a cargo vessel which is rotationally moored for allowing partial weather-vaning, according to an embodiment of the invention.

Another system for offloading LNG by use of the connection unit 30 is illustrated in FIG. 29 where the LNG carrier 10 is swing-moored or rotation moored, to a single mooring 390, in this example being the offshore access point 80. A mooring line 16 extends between the bow end of the LNG carrier 10 and the mooring 390 (i.e. the carrier 10 is bow moored). The flexible pipe 54 is connected to the mooring 390 and the mooring 390 has conduit for fluid communication between the flexible pipe 54 and the pipeline 81. The mooring 390 or part thereof may be above or below sea surface, e.g. at the seabed. An auxiliary vessel 8, e.g. a tug or the like, connects to the stern of the LNG carrier 10, to help to keep the mooring line 16 in tension and orient the LNG carrier 10 along a radial direction from the mooring 390. In this configuration, the LNG carrier 10 is free to move rotationally about the mooring 390, about a vertical axis, and will tend to align bow first toward the weather direction in response to weather imparted forces (i.e. weather vane). Typically the range of rotation about the mooring 390 is significant and in this case the LNG vessel 10 and the connection unit 30 are free to rotate in an arc of up to 180 degrees. The result is that significant higher operational uptime for offloading LNG can be obtained compared with a fixed moored solution. In general, the range of rotation is limited due to practical limitations to less than 360 degrees, and in the case illustrated is less than 180 degrees. The mooring 390 preferably does not require or does not have any swivels or rotating turret to achieve the swing mooring. Rather, the rotational movement is enabled by way of a limited amount of play in the mooring line and/or flexible pipe 54 where they attach to the mooring 390 and by the flexibility or bendability of the mooring line 16 and flexible pipe 54 around the mooring 390. In order to use the connection unit 30 to obtain a connection between the LNG carrier 10 with the flexible pipe 54 and the pipeline 81, the connection unit 30 is provided with propulsion such as motorized propellers 36 and dynamic position 37 to travel into position adjacent to the LNG carrier 30. The flexible pipe 54 in the water flexes to allow the connection unit 30 to remain in position on the LNG carrier 30 while hoses 52 are connected and it moves between different rotational positions about the access point 80 and mooring 390. Thus, offloading of LNG can continue while the LNG carrier weather vanes, and the weather vaning ability may allow the LNG carrier 10 to have an optimum orientation with respect to the weather direction in order to facilitate connection of the hoses 52 and offloading LNG in harsh weather conditions.

The mooring of the LNG carrier 10 in this system can be quicker since only one mooring line 16 needs to be connected. The mooring 390 can be a unit provided on the seabed or ground, which may be of a construction that does not require swivels or turret connections in order to allow rotation. The mooring location shown in FIG. 29 is located at an offshore access point 80 on an LNG pipeline bridge structure.

FIG. 29 shows different rotational positions for the LNG carrier 10 about the mooring 390, but it can be appreciated that in practice the LNG carrier occupies only one such position at a time.

In an alternative variant, a mooring buoy (anchored to the seabed, not shown) close to or adjacent to the pipeline bridge may be provided. This may enable a "softer" mooring system in which both the bow of the vessel and the connection unit 30 are connected to the buoy (via mooring line 16 and flexible pipe 54 respectively). In further alternatives, the mooring 390 may be provided by a floating LNG storage vessel or other floating installation instead of the LNG pipeline bridge.

Figure 30:
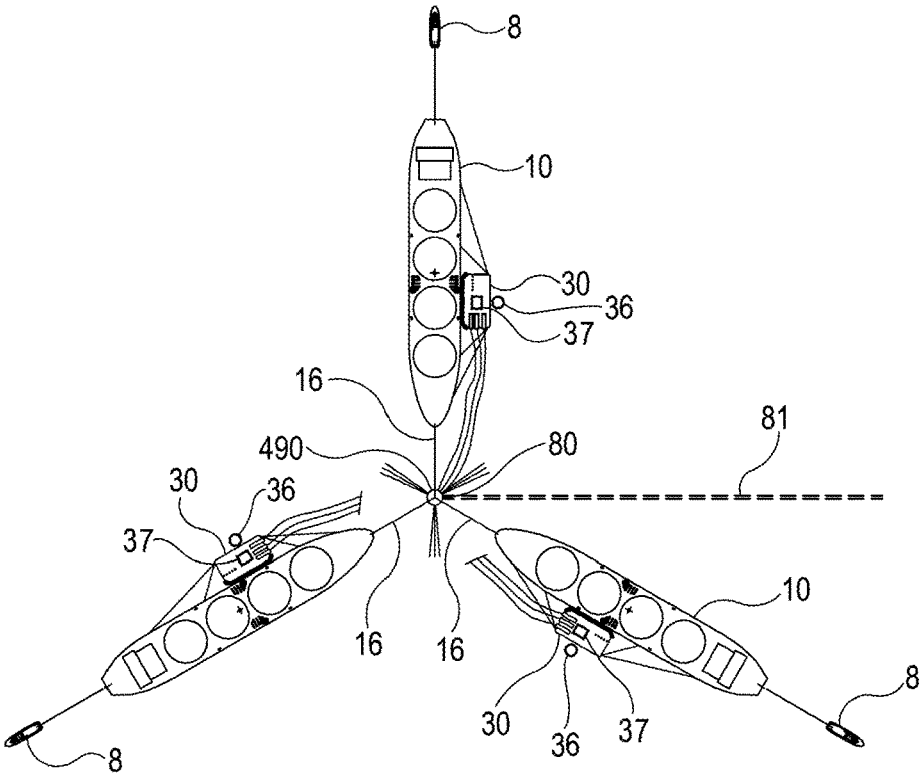
FIG. 30 is an overhead schematic representation of a system for offloading cargo from a cargo vessel which is rotationally moored about rotary mooring for full 360 degree weather-vaning, according to another embodiment of the invention.
Figure 31:
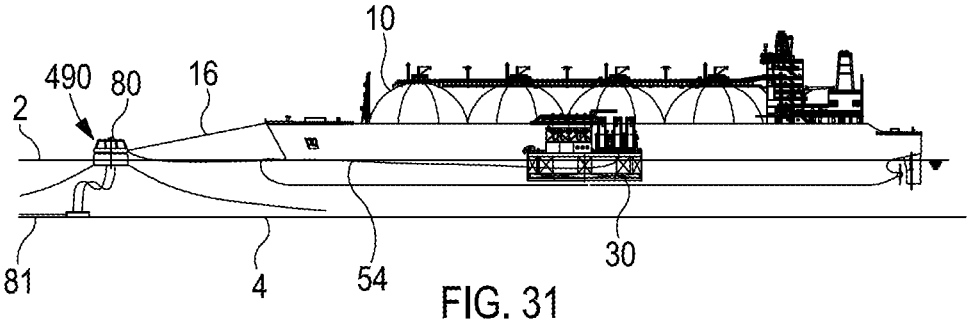
FIGS. 31 and 32 are side view representations of alternative rotary moorings for rotational mooring of the cargo vessel in the system of FIG. 30.
Figure 32:
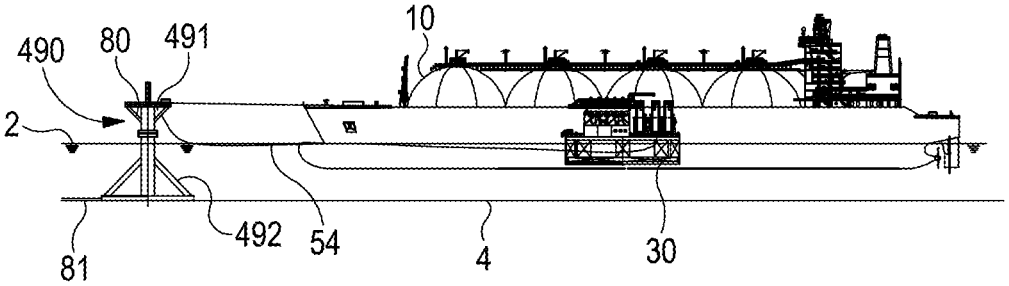
Figure 33:
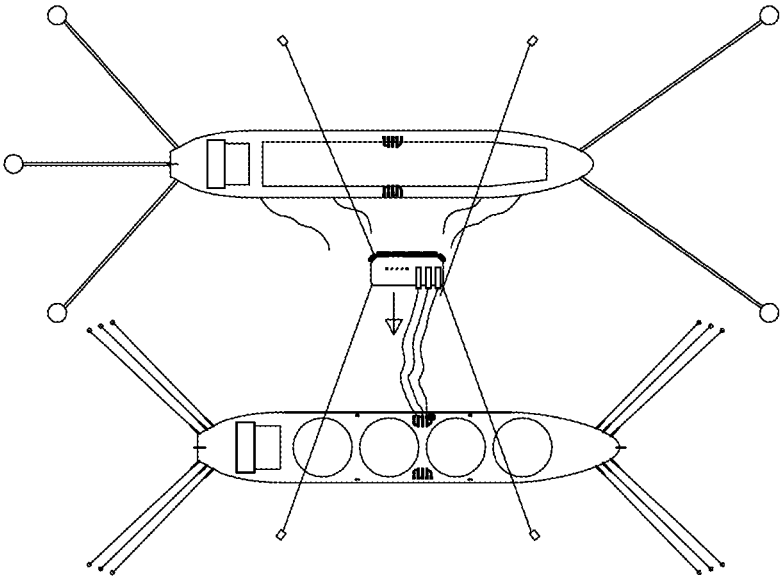
FIG. 33 is an overhead schematic representation of an emergency disconnection of the unit from the cargo vessel in the system of any of FIGS. 27 to 32.

In FIGS. 30 to 32, variants are shown in which the LNG vessel 10 is swing-moored or rotation moored to a single rotational mooring 490 at an offshore access point for transferring offloaded LNG to a pipeline 81 (i.e. single point moored). The LNG carrier 10 is allowed to rotate with the connection unit 30 positioned adjacent to the side of the carrier 10 and the hoses 52 connected to the cargo manifold 12. In this configuration, the LNG carrier 10 is free to rotate 360 degrees about a vertical axis at the mooring 490 and the bow end tends to align bow first toward the weather direction in response to weather imparted forces so as to weather vane. The mooring 490 has a swivel, and the mooring line 16 and the flexible pipe 54 are attached to an upper part of the swivel, which turns about a vertical axis as the LNG carrier 10 and the connection unit 30 are moved in response to the weather into different rotational orientations or headings.

The mooring line 16 extends in tension between the LNG carrier 10 and the mooring 490 assisted optionally with an auxiliary vessel 8 at the stern to maintain tension. In FIG. 31, the mooring 490 is in the form of a catenary anchor leg mooring (CALM) buoy which is anchored to the seabed. The upper part of the buoy (above the water line) has a swivel. The swivel has an upper part 491 arranged to swivel rotationally about a vertical axis with respect to a lower part 492. Connecting conduits are provided at the mooring 490 providing an access point 80 to a pipeline 81 for transporting offloaded LNG. With the flexible pipe 54 connected to the upper part of the mooring 490, there is provided for fluid communication between the flexible pipe 54 into the pipeline 81 through one or more connecting conduits. The flexible pipe 54 may be stored on hose reels 45 on the connection unit 30 adjacent to the buoy. When an LNG offloading operation is to take place, the flexible pipe 54 can be connected to the buoy close to the rotation point. The connecting conduits may be in the form of flexible submerged hoses extending from buoy above the surface down to a pipeline end manifold (PLEM) on the seabed.

In FIG. 32, the mooring 490 is in the form of a tower supported on the seabed 4, where an upper part 491 of the mooring 490 is above the sea surface and a lower part 492 rests in fixed position on the seabed. Upon rotation of the LNG carrier and connection unit 30 in response to the weather, the upper part 491, to which the mooring line 16 and pipes 54 connect, turns with respect to the lower part 492. Conduits through the tower provide fluid communication from the flexible pipe 54 for offloaded LNG to pass into the pipeline 81 on the seabed.

In variants in which the connection unit has a vaporizer 38, a vapor return line (e.g. from an onshore terminal to the vessel) through the swivel of the CALM buoy can be avoided. Hence, a proven 24" diameter in-line LNG swivel can be used at the CALM buoy. In an alternative configuration, a swivel with two or three fluid paths through the swivel may be provided, one of which may include a vapor return line.

In the embodiments described in which the connection unit 30 is moored to the cargo vessel 10 by mooring lines, the mooring is arranged such that the unit 30 can readily release from the cargo vessel 10 if required to do so unexpectedly e.g. in an emergency. In order to allow this, the connection unit 30 has releasable connectors, e.g. quick release hooks, to which the mooring lines are fastened when moored. The connectors can be released in an emergency to free the mooring lines and allow the connection unit leave the vessel 10.

The hoses 52 may also be equipped with emergency release couplers for quick and safe disconnection of the hoses 52 from the cargo vessel 10 if necessary, e.g. in an emergency situation (e.g. fire on the LNG carrier or similar). The release couplers may have two interoperable parts arranged to mate with one another in normal operation, but arranged to be disconnected from one another if required. Thus, when fitted to a hose 52, the hose may be detached and separated from the manifold 12 by way of disconnecting the respective parts of the coupler.

Thus, in the event of an emergency, the connection unit 30 can quickly disconnect from the LNG carrier 10 and move away by way of its autonomous propulsion.

Since the connection unit 30 can be readily disconnected and moved away, operations using the connection unit 30 to travel to and from the LNG vessel 10, can be safer than traditional operations at onshore terminals today. In effect, an LNG "terminal" in the form of the connection unit 30 may be moved away from the ship rather than the ship departing from the terminal. Moving the ship away can be more cumbersome and time consuming. Response times in the event of an emergency can therefore be improved by way of the present invention.

It can be appreciated that the embodiments described above can provide a number of benefits and advantages, particularly in relation to connecting tubing to an LNG carrier 10 for offloading LNG and performing LNG offloading operations.

Operation and transfer of LNG may be possible in rough sea states or in locations further offshore, compared with prior art solutions. This can be achieved in various embodiments, by way of the connection unit having low roll motion characteristic, provision for mooring the LNG vessel with bow aligned against the waves, provision of hose handling with constant tension winches to facilitate control of hose ends. In addition, the chain crawling system can be reliable and simple offering advantages over conventional propulsion or engaging other vessels in difficult sea conditions. This can lead to increasing the time windows in which LNG offloading can be carried out, and costs can be saved over traditional onshore moorings at jetties or behind breakwaters for offloading LNG. Moreover, the connection and offloading of LNG may be carried out safely. The connection to the LNG carrier can be performed efficiently and without needing to modify or install additional equipment on the LNG carrier itself.

Various modifications and improvements may be made without departing from the scope of the invention herein described. In embodiments with an offshore recipient, a pipeline 81 extending to the location of the offshore recipient may be provided on the sea floor. For instance, the pipeline 81 may be in the form of a submerged insulated LNG pipe-in-pipe from the shore and out to the offshore recipient. An alternative may be to construct an LNG pipeline bridge above the sea surface.

The connection unit 30 described in the above may be termed an "autonomous transfer system", and constitutes a unit for allowing connection of tubing to a cargo vessel for offloading cargo from the cargo vessel to a cargo recipient.

In particular, it may be appreciated that the connection unit 30 can be used for both the export and import of LNG. For example, with the connection unit 30 arranged as described above, rather than offloading, LNG could be loaded via the flexible pipe 54 onto the LNG carrier from a cargo supplier. In the loading case, the onshore or offshore storage facility or pipeline access point may serve as the cargo supplier. It can be appreciated therefore that the exact same arrangements as those described in relation to offloading can be applied but simply operated with the fluid being transferred through the tubing in a "reverse" direction such that instead of offloading the cargo from the cargo vessel to the recipient, the cargo is loaded onto the cargo vessel from the cargo supplier.

The systems described can also be used for loading or offloading other types of fluid from a cargo vessel, not only LNG. For instance, the cargo to be loaded onto or offloaded from the cargo vessel could be a liquid or gas which could be for instance liquefied petroleum gas (LPG).

The invention claimed is:

1. A system for offloading fluid cargo from a cargo vessel and delivering the fluid cargo to a cargo recipient, the system comprising:

a cargo vessel which is spread moored at sea to a plurality of mooring points for mooring the cargo vessel in a desired orientation, the fluid cargo to be offloaded from the cargo vessel;

tubing configured to be connected to the cargo vessel for fluid communication between the cargo vessel and the cargo recipient, the tubing comprising a first portion configured to be connected to the cargo vessel and a second portion configured to be connected to the cargo recipient; and a unit operable to travel across the sea and carry part of the tubing from a stand-by location to a position at or adjacent to the cargo vessel, so as to allow an end of the first portion of the tubing to be connected to the cargo vessel for offloading the fluid cargo through the tubing, whereby the fluid cargo is transmitted to the unit through the first portion of tubing and away from the unit to the cargo recipient through the second portion of tubing;

wherein the unit has at least one lifting and handling device, which with the first portion of the tubing coupled thereto and when the unit is positioned at or adjacent to the cargo vessel is operable to lift, maneuver, and land the end of the first portion of the tubing on the cargo vessel for arranging the end of the first portion of the tubing at or near a manifold on the cargo vessel for connection thereto.

2. A system as claimed in claim 1, wherein the unit is semi-submersible.

3. A system as claimed in claim 1, which further comprises a chain crawling propulsion system wherein at least one chain is anchored to the seabed, and the unit is configured to draw in the chain while the chain is anchored in order to propel the unit for travel across the sea between the stand-by location and the position adjacent to the cargo vessel.

4. A system as claimed in claim 1, wherein the cargo recipient comprises a subsea export pipeline arranged to transfer the cargo to an onshore cargo storage facility.

5. A system as claimed in claim 1, wherein the cargo recipient comprises a floating storage vessel.

6. A system as claimed in claim 1, wherein in the stand-by location and during travel to the position at or adjacent to the vessel, the second portion of the tubing is connected to the recipient.

7. A system as claimed in claim 1, wherein in the position at or adjacent to the vessel, the unit is urged against a side of the cargo vessel by either or both of: tension applied between the cargo vessel and said unit; and tension applied from said unit to at least one anchored seabed chain of a chain crawling propulsion system.

8. A system as claimed in claim 1, which further comprises a plurality of mooring points for providing the spread mooring of the cargo vessel for allowing the vessel to be moored in a plurality of headings, wherein the cargo vessel is spread moored to selected ones of the plurality of mooring points in a desired one of the plurality of headings.

9. A system as claimed in claim 1, wherein the cargo that is offloaded and transmitted from the vessel to the recipient through the tubing comprises liquefied natural gas or liquefied petroleum gas.

10. A system as claimed in claim 9, wherein the unit has a vapor generator that produces vapor from the liquefied natural gas or liquefied petroleum gas under offloading and transmission of the fluid cargo to the cargo recipient, the system further comprising a return line between the vapor generator on the unit and the cargo vessel, wherein the return line transmits the produced vapor through the return line into a depleted cargo tank of the cargo vessel.

11. A system as claimed in claim 1, wherein the unit further comprises at least one reel capable of storing and spooling out part of the second portion of the tubing for adapting an amount of extension of said second portion between the unit and the cargo recipient.

12. A system as claimed in claim 1, wherein the tubing comprises a first plurality of tubing portions to be connected to the vessel, and a second plurality of tubing portions to be connected to the cargo recipient.

13. A system as claimed in claim 1, wherein the unit further comprises at least one winch operable to pull in a seabed anchored chain of a chain crawling propulsion system and a control system configured to control the winch in order to drive the unit between the standby location and the location adjacent to the cargo vessel, the unit being operable in the adjacent location to allow the connection with the vessel to be obtained and the cargo to be offloaded.

14. A system as claimed in claim 1, wherein the lifting and handling device comprises a crane.

15. A system as claimed in claim 14, wherein the crane comprises a winch for controlling a cable of the crane, an end of the cable being coupled to the end of the first portion of the tubing, the winch being a constant tension winch arranged to adapt an amount of pay out of the cable for suppressing wave motion effects on the position of the end of the cable.

16. A system as claimed in claim 1, wherein the lifting and handling device is configured to lift, maneuver, and land the end of the first portion of the tubing on a saddle structure on the cargo vessel at or adjacent to the cargo manifold under control of a winch which is operable to pay out a cable to which the first portion of the tubing is coupled, to suppress wave motion effects on the end of the first portion of the tubing.

17. A system as claimed in claim 1, wherein the lifting and handling device comprises an articulated arm extender.

18. A system as claimed in claim 17, wherein the first portion of the tubing comprises hosing.

19. A system as claimed in claim 17, wherein the articulated arm extender has a pair of adjacent arm sections which can be angled to form a V-shape.

20. A system as claimed in claim 1, wherein the fluid cargo that is offloaded and delivered to the recipient comprises liquefied natural gas or liquefied petroleum gas, and at least one of the first and second portions comprises an LNG or LPG hose.

21. A system for offloading fluid cargo from a cargo vessel and delivering the fluid cargo to a cargo recipient, the system comprising:

a cargo vessel which is moored at sea to a mooring point anchored to the seabed such that the cargo vessel is allowed to rotate about the mooring point in response to weather conditions, the fluid cargo to be offloaded from the cargo vessel;

tubing configured to be connected to the cargo vessel for fluid communication through the tubing between the cargo vessel and the cargo recipient, the tubing comprising a first portion configured to be connected to the cargo vessel and a second portion configured to be connected to the cargo recipient; and a unit operable to travel across the sea and carry part of the tubing from a stand-by location to a position at or adjacent to the cargo vessel, so as to allow an end of the first portion of the tubing to be connected the cargo vessel for offloading the fluid cargo through the tubing, whereby the fluid cargo is transmitted to the unit through the first portion of tubing and away from the unit to the cargo recipient through the second portion of tubing;

wherein the unit has at least one lifting and handling device which with the first portion of the tubing coupled thereto and when the unit is positioned at or adjacent to the cargo vessel is operable to lift, maneuver, and land the end of the first portion of the tubing on the cargo vessel for arranging the end of the first portion of the tubing at or near a manifold on the cargo vessel for connection thereto.

22. A system as claimed in claim 21, wherein the unit is semi-submersible.

23. A system as claimed in claim 21, wherein the unit is fitted with propellers and positioning systems for operating the propellers to maneuver the unit into the position at or adjacent to the vessel.

24. A system as claimed in claim 21, wherein the second portion of the tubing is flexible to allow sufficient movability of the unit to move into the position at or adjacent to one side of the cargo vessel in any rotational orientation about the mooring point.

25. A system as claimed in claim 21, wherein the unit further comprises at least one reel capable of storing and spooling out part of the second portion of the tubing for adapting an amount of extension of said second portion between the unit and the cargo recipient.

26. A system as claimed in claim 21, wherein the tubing comprises a first plurality of tubing portions to be connected to the vessel, and a second plurality of tubing portions to be connected to the cargo recipient.

27. A system as claimed in claim 21, wherein the lifting and handling device comprises a crane.

28. A system as claimed in claim 27, wherein the crane comprises a winch for controlling a cable of the crane, an end of the cable being coupled to the end of the first portion of the tubing, the winch being a constant tension winch arranged to adapt an amount of pay out of the cable for suppressing wave motion effects on the position of the end of the cable.

29. A system as claimed in claim 21, wherein the lifting and handling device is configured to lift, maneuver, and land the end of the first portion of the tubing on a saddle structure on the cargo vessel at or adjacent to the cargo manifold under control of a winch which is operable to pay out a cable to which the first portion of the tubing is coupled to suppress wave motion effects on the end of the first portion of the tubing.

30. A system as claimed in claim 21, wherein the lifting and handling device comprises an articulated arm extender.

31. A system as claimed in claim 30, wherein the first portion of the tubing comprises hosing.

32. A system as claimed in claim 30, wherein the at least one lifting and handling device comprises an articulated arm extender, wherein the articulated arm extender has a pair of adjacent arm sections which can be angled to form a V-shape.

33. A system as claimed in claim 21, wherein the cargo comprises LNG or LPG, and the unit further comprises a vaporizer for producing vapor from the LNG or LPG being offloaded and return tubing for returning the produced vapor to a depleted cargo tank on the cargo vessel.

34. A system as claimed in claim 21, wherein the fluid cargo that is offloaded and delivered to the recipient comprises liquefied natural gas or liquefied petroleum gas, and at least one of the first and second portions comprises an LNG or LPG hose.

35. A system for loading fluid cargo onto a cargo vessel from a cargo supplier, the system comprising:

a cargo vessel which is spread moored at sea to a plurality of mooring points for mooring the cargo vessel in a desired orientation, the cargo to be loaded onto the cargo vessel;

tubing configured to be connected to the cargo vessel for fluid communication between the cargo vessel and the cargo supplier, the tubing comprising a first portion configured to be connected to the cargo vessel and a second portion configured to be connected to the cargo supplier; and a unit operable to travel across the sea and carry part of the tubing from a stand-by location to a position at or adjacent to the cargo vessel, so as to allow an end of the first portion of the tubing to be connected to the cargo vessel for loading the fluid cargo through the tubing, whereby the fluid cargo is transmitted to the unit through the second portion of tubing and from the unit to the cargo vessel through the first portion of tubing;

wherein the unit has at least one lifting and handling device, which with the first portion of the tubing coupled thereto and when the unit is positioned at or adjacent to the cargo vessel is operable to lift, maneuver, and land the end of the first portion of the tubing on the cargo vessel for arranging the end of the first portion of the tubing at or near a manifold on the cargo vessel for connection thereto.

36. A system as claimed in claim 35, wherein the unit is semi-submersible.

37. A system for loading fluid cargo onto a cargo vessel from a cargo supplier, the system comprising:

a cargo vessel which is moored at sea to a mooring point anchored to the seabed such that the cargo vessel is allowed to rotate about the mooring point in response to weather conditions, the fluid cargo to be loaded onto the cargo vessel;

tubing configured to be connected to the cargo vessel for fluid communication between the cargo vessel and the cargo supplier, the tubing comprising a first portion configured to be connected to the cargo vessel and a second portion configured to be connected to the cargo supplier; and a unit operable to travel across the sea and carry part of the tubing from a stand-by location to a position at or adjacent to the cargo vessel, so as to allow an end of the first portion of the tubing to be connected the cargo vessel for loading the fluid cargo through the tubing, whereby the fluid cargo is transmitted to the unit through the second portion of tubing and from the unit to the cargo vessel through the first portion of tubing;

wherein the unit has at least one lifting and handling device which with the first portion of tubing coupled thereto and when the unit is positioned at or adjacent to the cargo vessel is operable to lift, maneuver, and land the end of the first portion of the tubing on the cargo vessel for arranging the end of the first portion of the tubing at or near a manifold on the cargo vessel for connection thereto.

38. A system as claimed in claim 37, wherein the unit is semi-submersible.

* * * * *